US010011125B2

(12) United States Patent
Segawa et al.

(10) Patent No.: US 10,011,125 B2
(45) Date of Patent: Jul. 3, 2018

(54) RECORDING SYSTEM

(71) Applicant: SEIKO EPSON CORPORATION, Tokyo (JP)

(72) Inventors: Yuichi Segawa, Shiojiri (JP); Hirohisa Adachi, Matsukawa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/453,340

(22) Filed: Mar. 8, 2017

(65) Prior Publication Data

US 2017/0282598 A1 Oct. 5, 2017

(30) Foreign Application Priority Data

Apr. 4, 2016 (JP) ..... 2016-074978
Dec. 28, 2016 (JP) ..... 2016-255063

(51) Int. Cl.
*B41J 29/02* (2006.01)
*B41J 11/04* (2006.01)

(52) U.S. Cl.
CPC ..... *B41J 11/04* (2013.01); *B41J 29/02* (2013.01)

(58) Field of Classification Search
CPC . B41J 11/04; B41J 29/02; B41J 29/026; B41J 29/04; B41J 29/13
See application file for complete search history.

(56) References Cited

U.S. PATENT DOCUMENTS 5,845,899 A 12/1998 Satoh et al.
5,918,089 A * 6/1999 Malinich ..... G03G 15/80 361/809
6,308,026 B1 10/2001 Kouchi
7,298,987 B2 * 11/2007 Tokishige ..... G03G 21/1652 399/107
9,164,453 B2 10/2015 Kotera
2004/0208669 A1 10/2004 Tokishige et al.
2012/0044530 A1 2/2012 Kato et al.
2012/0134728 A1 5/2012 Kotera
2015/0360461 A1 12/2015 Sakata

FOREIGN PATENT DOCUMENTS

EP 2781964 A2 9/2014
JP 2012-118283 A 6/2012

OTHER PUBLICATIONS

European Search Report for Application No. 17162678 dated Aug. 15, 2017.

* cited by examiner

*Primary Examiner* — Anh T. N. Vo
(74) *Attorney, Agent, or Firm* — Workman Nydegger

(57) ABSTRACT

There is provided a recording system including: a first linking portion which regulates a position of a housing with respect to the other housing and links the housing and the other housing; and a second linking portion which regulates a position of the housing with respect to the other housing, applies a load received from the other housing to the housing, and links the housing and the other housing to each other.

8 Claims, 14 Drawing Sheets

RECORDING SYSTEM

CROSS REFERENCES TO RELATED APPLICATIONS

The entire disclosure of Japanese Patent Application Nos. 2016-074978, filed Apr. 4, 2016 and 2016-255063, filed Dec. 28, 2016 are expressly incorporated by reference herein.

BACKGROUND

1. Technical Field

The present disclosure relates to a recording system.

2. Related Art

From the related art, a recording system including: a recording portion which ejects ink as liquid; a recording apparatus which records an image, such as a character or a picture, by allowing the ink to adhere to a paper sheet which is an example of a recording medium; and a post processing apparatus which performs post processing, such as stapling, punching, or sorting, with respect to the paper sheet on which the recording is performed by the recording apparatus, is known.

For example, in JP-A-2012-118283, the post processing apparatus which performs the post processing, such as stapling, punching, or sorting, is attached to a main body side surface of the recording apparatus. The paper sheet on which the recording is performed in a main body of the recording apparatus and which is discharged from a main body side is delivered to the post processing apparatus side.

In the recording system, there is a system in which the paper sheet is discharged by a discharge roller pair provided in a housing of the recording apparatus, and delivered to the transport roller pair provided in the post processing apparatus. Rotation axes of each of a discharge roller pair and a transport roller pair are disposed to be parallel to each other at positions in the height direction at which the paper sheet can be delivered.

However, when the post processing apparatus is attached to the main body side surface of the recording apparatus, there is a case where distortion is generated in the housing of the recording apparatus as a load of the post processing apparatus is applied to the housing of the recording apparatus. Since the discharge roller pair is supported in the housing of the recording apparatus, when the distortion is generated in the housing of the recording apparatus, there is a case where the position of the discharge roller pair is deviated or the rotation axes of each of the discharge roller pair and the transport roller pair are not disposed to be parallel each other. Therefore, when the paper sheet discharged from the discharge roller pair is delivered to the transport roller pair, so-called inclination of the paper sheet in which the paper sheet is inclined with respect to the transport direction is generated, and there is a problem that the paper sheet is transported to the downstream side while being inclined.

In addition, since the recording portion which ejects the ink is also supported in the housing of the recording apparatus, when the distortion is generated in the housing of the recording apparatus, there is a case where a relative position between the paper sheet to be transported and the recording portion may change. Therefore, there is a problem that positional accuracy of the ink ejected to the paper sheet decreases and quality of an image recorded on the paper sheet deteriorates.

SUMMARY

An advantage of some aspects of the disclosure is to improve positional accuracy of ink ejected to a paper sheet and to improve quality of an image recorded on a paper sheet.

The disclosure can be realized as the following aspects or application examples.

Application Example 1

According to this application example, there is provided a recording system including: a first housing which holds a recording portion that performs recording on a recording medium on the inside thereof, and supports a discharge roller pair that discharges the recording medium onto which the recording is performed by the recording portion; a second housing which is disposed on an outer side of the first housing; a third housing which holds a first post processing portion that performs first post processing on the inside thereof, and supports a transport roller pair that receives the recording medium discharged by the discharge roller pair and transports the recording medium to the first post processing portion side; a first linking portion which regulates a position of the second housing with respect to the first housing, and links the first housing and the second housing to each other; and a second linking portion which regulates a position of the third housing with respect to the second housing, applies a load received from the third housing to the second housing, and links the second housing and the third housing to each other.

According to the application example, the second linking portion which regulates a position of the third housing with respect to the second housing, applies a load received from the third housing to the second housing, and links the second housing and the third housing to each other, is provided. Accordingly, since the load received from the third housing is not applied to the first housing, distortion is not generated in the first housing. Therefore, the position of the discharge roller pair supported by the first housing is not deviated, and the rotation axes of each of the discharge roller pair and the transport roller pair are disposed to be parallel to each other. Therefore, when the recording medium discharged from the discharge roller pair is nipped and delivered by the transport roller pair, inclination of the recording medium with respect to the transport direction is suppressed. In addition, the relative positions of the transported recording medium and the recording portion are appropriately held as the distortion is not generated in the first housing. Accordingly, positional accuracy of liquid ejected to the recording medium is ensured, and it is possible to suppress deterioration of quality of an image recorded on the recording medium.

Application Example 2

In the recording system according to the application example, a fourth housing which receives the recording medium discharged from the first post processing portion, and holds a second post processing portion that performs predetermined second post processing with respect to the recording medium on the inside thereof, may be provided.

According to the application example, in a state where an inclination angle with respect to the transport direction is small, the recording medium which passes through the first post processing portion is transported to the second post processing portion. Accordingly, appropriate processing is performed in the second post processing portion.

Application Example 3

In the recording system according to the application example, the second linking portion may include a protrusion portion which is provided on one side and protrudes to the other side, and a hole portion which is provided on the other side and is open to one side, in the second housing and the third housing, and a position of the third housing with respect to the second housing may be regulated by fitting the protrusion portion to the hole portion.

According to the application example, in a state where the protrusion portion is fitted to the hole portion, the position in the direction which intersects with a direction in which the second housing and the third housing are aligned is regulated, and in the aligning direction, the distance between the second housing and the third housing is changeable. Therefore, it is possible to easily attach and detach the third housing to and from the second housing.

Application Example 4

In the recording system according to the application example, a load receiving portion which is in contact with an installation surface, and receives a part of the load received from the third housing may be provided on a side opposite to the second housing side in a bottom portion of the third housing, and the second housing side in the bottom portion of the third housing may not abut against the installation surface.

According to the application example, the load received from the third housing is received by the load receiving portion and the second linking portion. Accordingly, the position of the third housing on the second housing side is regulated by the position linked by the second linking portion.

Application Example 5

In the recording system according to the application example, the second linking portion may include a rotatable engagement portion provided in the third housing, and an engaged portion that is provided in the second housing and is engageable with the engagement portion, and the engagement portion may be in a state of being engaged with the engaged portion when being rotated in one direction in a rotational direction, and in a state of not being engaged with the engaged portion when being rotated in the other direction in the rotational direction.

According to the application example, work of placing the second linking portion to be in a linked state, or workability when releasing the linked state of the second linking portion is excellent.

Application Example 6

In the recording system according to the application example, the second housing may include a first abutting member at a position that opposes the third housing further at a lower part than the first linking portion and the second linking portion, the third housing may include a second abutting member at a position that opposes the first abutting member, and a position in a direction in which the second housing and the third housing are aligned may be regulated as the first abutting member and the second abutting member abut against each other.

According to the application example, since the first abutting member and the second abutting member are disposed at positions opposing each other, by allowing the first abutting member and the second abutting member to abut against each other, in a state where the second housing and the third housing are linked to each other by the second linking portion, the position in the direction in which the second housing and the third housing are aligned is regulated.

Application Example 7

In the recording system according to the application example, the first abutting member may be a conductive member, and the first abutting member may include an overhang portion which is overhung on the third housing side, and a conduction member which is conducted to the inside of the third housing may be disposed in the overhang portion.

According to the application example, since the conduction member is disposed in the overhang portion which is overhung on the third housing side, it is possible to insert the conduction member into a lower part of the third housing, to bring the conduction member and the third housing into contact with each other, and to conduct to the inside of the third housing.

Application Example 8

In the recording system according to the application example, the conduction member may have elasticity and may be conducted to the inside of the third housing.

According to the application example, since the conduction member has elasticity, the conduction member is inserted into a lower part of the third housing, the elasticity of the conduction member to the third housing side is used, and accordingly, it is possible to stably bring the conduction member and the third housing into contact with each other. Therefore, it is possible to reliably conduct to the inside of the third housing.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
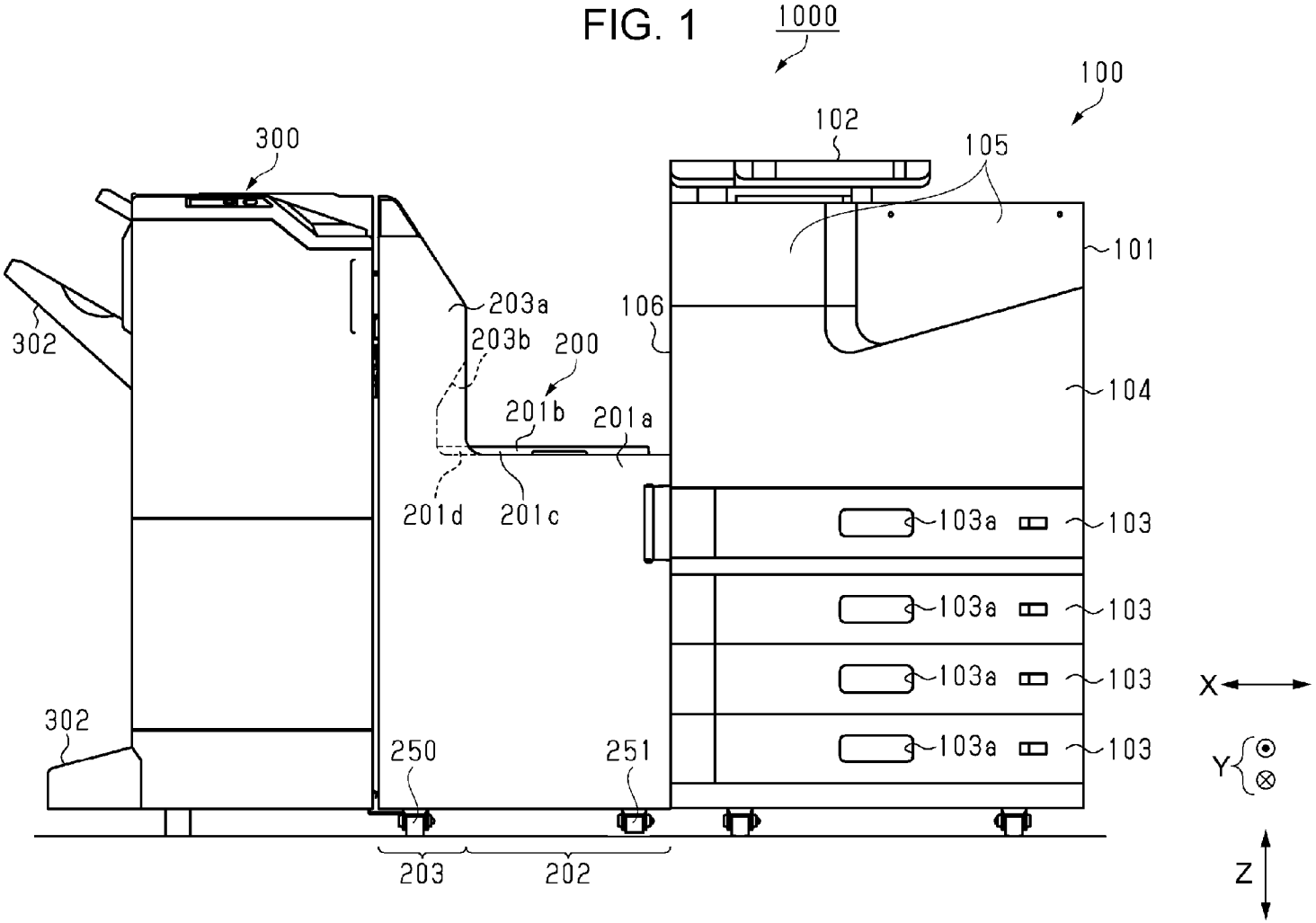
FIG. 1 is a front view illustrating an external appearance of an embodiment of a recording system.

Hereinafter, a recording system which is an example of an embodiment will be described. FIG. 1 is a front view illustrating an external appearance of a recording system 1000 in the embodiment. The recording system 1000 includes: a printer 100 which is an example of a recording apparatus that records an image on a paper sheet P which is a recording medium; a first post processing apparatus 200 which performs predetermined first post processing with respect to the paper sheet P on which the image is recorded by the printer 100; and a second post processing apparatus 300 which performs predetermined second post processing with respect to the paper sheet P to which the first post processing is performed by the first post processing apparatus 200.

The recording system 1000 is configured as the printer 100, the first post processing apparatus 200, and the second post processing apparatus 300 are disposed to be aligned in order from a right side to a left side in a leftward-and-rightward direction X in FIG. 1. In other words, by considering the leftward-and-rightward direction X as an alignment direction, the printer 100 and the first post processing apparatus 200 are adjacent to each other, the first post processing apparatus 200 and the second post processing apparatus 300 are adjacent to each other, and the first post processing apparatus 200 is disposed between the printer 100 and the second post processing apparatus 300.

The printer 100 is an ink jet type printer which records an image, such as a character or a picture, by allowing ink which is liquid to adhere to the paper sheet P. An apparatus main body 101 is covered with an exterior cover 105, a front plate cover 104 provided on a front surface, and a pullout cover 106 provided on a side surface on a left side of the drawing. A side surface and a rear surface on a right side of the drawing of the apparatus main body 101 are also covered with the exterior cover that is not illustrated, and an external appearance of the apparatus main body 101 is a substantially rectangular parallelepiped shape.

In a vertical direction Z, an operation portion 102 for performing various operations of the printer 100 is provided in an upper portion of the apparatus main body 101. Hereinafter, description of an upper portion, a lower portion, an upper part, a lower part, an upper side, and a lower side is referred to as a part or a direction in the vertical direction Z.

In the printer 100, a paper cassette 103 is provided from a center portion to a lower portion in the vertical direction Z of the printer 100. Four paper cassettes 103 are disposed being aligned in the vertical direction Z, and the paper sheets P onto which the printer 100 performs the recording are accommodated in each of the paper cassettes 103 in a stacked state.

In the center portions in the leftward-and-rightward direction X in the paper cassettes 103, grip portions 103*a* which can be gripped by a user are respectively formed. The paper cassette 103 is configured to be insertable into the apparatus main body 101 in a forward-and-rearward direction Y which intersects with both of the leftward-and-rightward direction X and the vertical direction Z. The paper sheets P accommodated in each of the paper cassettes 103 may be different types from each other, and may be the same type.

The first post processing apparatus 200 performs the first post processing with respect to the paper sheet P onto which the recording is performed by the printer 100. In the first post processing in the embodiment, drying processing of the paper sheet P is performed. By performing the transport for a predetermined period of time or more with respect to the paper sheet P, the first post processing apparatus 200 dries the paper sheet P. Therefore, by saving the transport time of the paper sheet P, it is possible to suppress a degree of curl generated on the paper sheet P due to the recording by a recording portion 110 (refer to FIG. 2).

The first post processing apparatus 200 includes: a box-like main body portion 201*a* of which a part of the upper part is open; and an upper surface portion 201*b* including a first plate-like member 201*c* and a second plate-like member 201*d* which are provided to be freely opened and closed in an upwardly opening portion of the main body portion 201*a*.

The main body portion 201*a* is configured to include: a lead-in portion 202 which leads in the paper sheet P on which the recording is performed by the printer 100, and a lead-out portion 203 which is positioned further on the left side in FIG. 1 in the leftward-and-rightward direction X than the lead-in portion 202, and leads out the paper sheet P to the second post processing apparatus 300.

The lead-out portion 203 is further provided with an extending portion 203*a* which protrudes further upward than the upper surface portion 201*b* at a part adjacent to the second post processing apparatus 300. The extending portion 203*a* is provided with a recess portion 203*b* which is recessed on the printer 100 side, that is, on the second post processing apparatus 300 side at a part on a lower side in the vertical direction Z. A part of the upper surface portion 201*b* is disposed on the inside of the recess portion 203*b*. The second plate-like member 201*d* which is an end portion on the second post processing apparatus 300 side of the upper surface portion 201*b* is positioned in the lower end portion of the recess portion 203*b*.

The second post processing apparatus 300 performs the second post processing with respect to the paper sheet P onto which the recording is performed by the printer 100 and which is transported by the first post processing apparatus 200. Examples of the second post processing include cutting, folding, punching, stapling, and sorting. In addition, the paper sheet P, onto which the second post processing is performed, is loaded on a paper discharge portion 302 which extends leftward from the left side surface of the second post processing apparatus 300.

Figure 2:
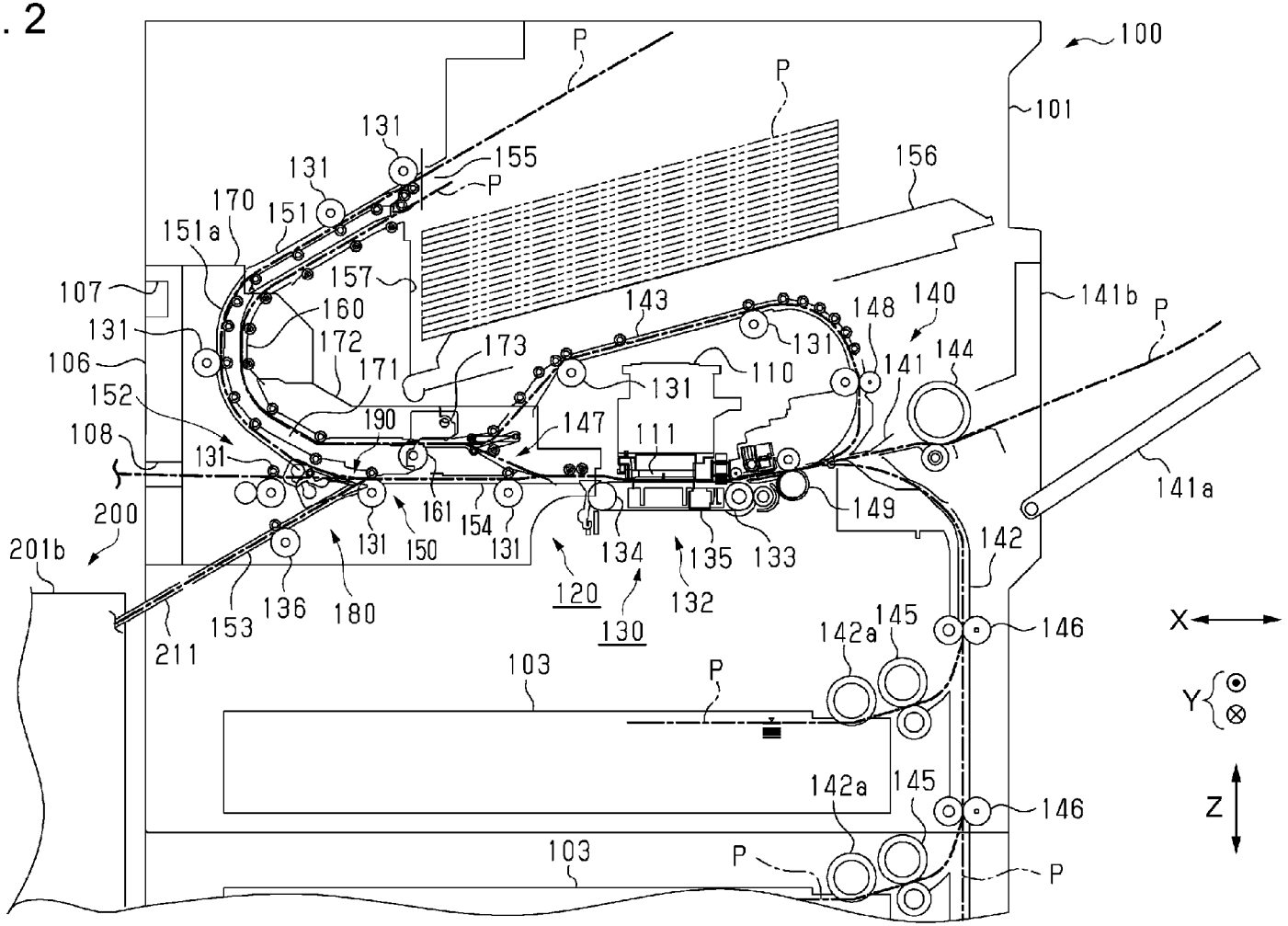
FIG. 2 is a schematic structure view of a printer.

Next, a structure of the printer 100 will be described. FIG. 2 is a schematic structure view of the printer 100. On the inside of the apparatus main body 101, the recording portion 110 which performs the recording from the upper side in the vertical direction Z onto the paper sheet P, and a transport portion 130 which transports the paper sheet P along a transport path 120 are provided. The transport path 120 is formed so that the paper sheet P is transported by considering a direction that intersects with a width direction as the transport direction, when a direction along the forward-and-rearward direction Y is considered as the width direction of the paper sheet P.

The recording portion 110 is provided with a line head type recording head 111 which can dispense the ink at the same time across substantially the entire region of the paper sheet P in the width direction, at a lower portion thereof. The recording portion 110 forms an image on the paper sheet P as the ink dispensed from the recording head 111 adheres to a recording surface (a surface on which the image is printed) which opposes the recording head 111 on the paper sheet P.

The transport portion 130 includes a plurality of transport roller pairs 131 which are disposed along the transport path 120, and a belt transport portion 132 which is provided immediately below the recording portion 110. With respect to the paper sheet P transported by the belt transport portion 132, the ink is dispensed from the recording head 111 and the recording is performed.

The belt transport portion 132 includes: a driving roller 133 which is disposed further on the upstream side in the transport direction (right side of the drawing in the leftward-and-rightward direction X) than the recording head 111; a driven roller 134 which is disposed further on the downstream side in the transport direction (left side of the drawing in the leftward-and-rightward direction X) than the recording head 111; and an endless circular belt 135 which is wound around each of the rollers 133 and 134. The belt 135 revolves as the driving roller 133 is driven to be rotated, and the paper sheet P is transported to the downstream side by the revolving belt 135. In other words, an outer circumferential surface of the belt 135 functions as a supporting surface which supports the paper sheet P on which the recording is performed.

The transport path 120 includes: a supply path 140 through which the paper sheet P is transported toward the recording portion 110; a discharge path 150 through which the paper sheet P on which the recording is performed and the recording has been completed by the recording portion 110 is transported; and a branch path 160 which branches from the discharge path 150.

The supply path 140 includes a first supply path 141, a second supply path 142, and a third supply path 143. In the first supply path 141, the paper sheet P inserted from an insertion port 141*b* which is exposed by opening a cover 141*a* provided on the right side surface of the apparatus main body 101, is transported to the recording portion 110. A first driving roller pair 144 is provided in the first supply path 141, and the paper sheet P inserted from the insertion port 141*b* is linearly transported toward the recording portion 110 as the first driving roller pair 144 is driven to be rotated.

In the second supply path 142, the paper sheets P which are accommodated in each of the paper cassettes 103 provided in the lower portion of the apparatus main body 101 are transported to the recording portion 110 in the vertical direction Z. In the vicinity of each of the paper cassettes 103 in the second supply path 142, a pick-up roller 142*a* and a separation roller pair 145 are provided. Among the paper sheets P accommodated in a stacked state on the paper cassettes 103, the uppermost paper sheet P is sent out by the pick-up roller 142*a*, and the paper sheets P are separated one by one by the separation roller pair 145. Then, while reversing the posture in the vertical direction Z, the paper sheets P are transported toward the recording portion 110 as a second driving roller pair 146 provided in the second supply path 142 is driven to be rotated.

In the third supply path 143, in a case where duplex printing which records the image on both surfaces of the paper sheet P is performed, the paper sheet P on which the recording has been completed on one surface by the recording portion 110 is transported to the recording portion 110 again. In other words, further on the downstream side than the recording portion 110 in the transport direction, the branch path 160 which branches from the discharge path 150 is provided. In other words, when performing the duplex printing, the paper sheet P is transported to the branch path 160 by an operation of a branch mechanism 147 provided in the middle of the discharge path 150. In addition, in the branch path 160, a branch path roller pair 161 which can rotate both normally and reversely is provided further on the downstream side than the branch mechanism 147.

When performing the duplex printing, the paper sheet P of which one surface is printed is guided to the branch path 160 by the branch mechanism 147, and is transported to the downstream side in the branch path 160 by the branch path roller pair 161 which normally rotates. After this, the paper sheet P transported to the branch path 160 is reversely transported to the upstream side from the downstream side in the branch path 160 by the branch path roller pair 161 which reversely rotates.

The paper sheet P which is reversely transported from the branch path 160 is transported to the third supply path 143, and is transported toward the recording portion 110 by the plurality of transport roller pairs 131. The third supply path 143 detours the recording portion 110, and is joined with the first supply path 141 and the second supply path 142 further on the upstream side than the recording portion 110. Therefore, as the paper sheet P is transported through the third supply path 143, the paper sheet P is reversed so that the other surface which is not printed opposes the recording portion 110, and is transported toward the recording portion 110 as a third driving roller pair 148 is driven to be rotated. In other words, the third supply path 143 functions as a reverse transport path which transports the paper sheet P while reversing the posture of the paper sheet P in the vertical direction Z.

Among the supply paths 141, 142, and 143, the second supply path 142 and the third supply path 143 transport the paper sheet P toward the recording portion 110 while making the posture of the paper sheet P curved in the vertical direction Z. Meanwhile, compared to the second supply path 142 and the third supply path 143, the first supply path 141 transports the paper sheet P toward the recording portion 110 without making the posture of the paper sheet P largely curved.

After the paper sheet P transported through each of the supply paths 141, 142, and 143 is transported to an aligning roller pair 149 installed further on the upstream side than the recording portion 110 in the transport direction, a tip end thereof abuts against the aligning roller pair 149 which stopped rotating. In addition, inclination of the paper sheet P with respect to the transport direction is corrected (skew removing) by the state where the paper sheet P abuts against the aligning roller pair 149. After this, the paper sheet P of which the inclination is corrected is transported to the recording portion 110 in an aligned state as the aligning roller pair 149 is driven to be rotated.

The paper sheet P on which the recording is performed on one surface or on both surfaces by the recording portion 110 and the recording has been completed, is transported along the discharge path 150 which configures the downstream portion of the transport path 120 by the transport roller pair 131. The discharge path 150 branches to a first discharge path 151, the second discharge path 152, and a third discharge path 153 at a position which is further on the downstream side than the position of branching from the branch path 160. In other words, the paper sheet P on which the recording has been completed is transported through a common discharge path 154 which configures the upstream portion of the discharge path 150. After this, the paper sheet P on which the recording has been completed is guided to any path among each of the first to the third discharge paths 151, 152, and 153 which configure the downstream portion of the discharge path 150, by a guiding mechanism 180 which is provided at a downstream end of the common discharge path 154.

The first discharge path 151 is provided to be oriented toward the upper part of the apparatus main body 101, and to extend being curved along the branch path 160. The paper sheet P transported through the first discharge path 151 is discharged from a discharge port 155 which is open at a part of the apparatus main body 101 to be a terminal end of the first discharge path 151. In addition, the paper sheet P discharged from the discharge port 155 falls to the lower side in the vertical direction Z, and is fed to a loading table 156 in a stacked state, as illustrated by a two-dot chain line in FIG. 2. In addition, by the transport roller pairs 131 disposed at a plurality of locations of the discharge path 150, the paper sheet P is fed to the loading table 156 in a posture that the recording surface faces downward in the vertical direction Z when simplex printing is performed, from the discharge port 155.

The loading table 156 has a shape inclined to ascend upward, which rises to the upper side in the vertical direction Z when approaching in a rightward direction in the leftward-and-rightward direction X, and the paper sheets P are loaded in the stacked state on the loading table 156. At this time, each of the paper sheets P loaded on the loading table 156 moves in a leftward direction along the inclination of the loading table 156, and is loaded being close to a vertical side wall 157 provided on the lower side of the discharge port 155 of the apparatus main body 101.

In addition, the first discharge path 151 includes a curved reverse path 151*a* which reverses front and rear surfaces of the paper sheet P while the paper sheet P on which the recording is performed by the recording portion 110 is transported to the discharge port 155. In other words, the curved reverse path 151*a* makes the paper sheet P curved by considering the recording surface of the paper sheet P on which the recording is performed by the recording portion 110 as an inner side, and reverses the paper sheet P from a state where the recording surface of the paper sheet P is oriented toward the upper side in the vertical direction Z, in the vertical direction Z, to a state where the recording surface is oriented toward the lower side in the vertical direction Z. Therefore, the paper sheet P is discharged from the discharge port 155 in a state where the recording surface faces the loading table 156 when the simplex printing is performed as the paper sheet P passes through the curved reverse path 151*a*.

The second discharge path 152 branches further to the lower side than the first discharge path 151, and linearly extends toward the first post processing apparatus 200 side from the recording portion 110. Therefore, the paper sheet P transported through the second discharge path 152 is not transported in a curved posture similar to the first discharge path 151, is linearly transported while constantly maintaining the posture similar to the posture when the paper sheet P passes through the recording portion 110, and is discharged toward the upper surface portion 201*b* of the first post processing apparatus 200 from a discharge port 108. In other words, the second discharge path 152 functions as a non-reverse discharge path which transports the paper sheet P toward the upper surface portion 201*b* without reversing the posture of the paper sheet P in the vertical direction. As the plurality of paper sheets P which sequentially pass through the second discharge path 152 are discharged from the discharge port 108 and fall, the paper sheets P are stacked on the upper surface portion 201*b*.

The third discharge path 153 branches further to the lower side than the second discharge path 152, and extends toward the lower side being inclined so as to be oriented toward the lower part of the apparatus main body 101, and the downstream end is connected to the upstream end of a lead-in path 211 provided in the first post processing apparatus 200 in the apparatus main body 101.

In the third discharge path 153, a discharge roller pair 136 is provided, and the paper sheet P transported through the third discharge path 153 is transported to the lead-in path 211 side by the discharge roller pair 136.

The front plate cover 104 of FIG. 1 is provided to be rotatable considering a long side adjacent to the uppermost paper cassette 103 as a base end. By opening the front plate cover 104, a part of the transport path 120 of FIG. 2 is exposed. Accordingly, when a transport failure of the paper sheet P is generated in the transport path 120, it is possible to remove the paper sheet P.

The pullout cover 106 of FIG. 2 includes a handle portion 107 for a user to put a hand thereon, and is provided to be capable of being pulled out from the apparatus main body 101. When the pullout cover 106 is pulled out to the left side of the drawing from the apparatus main body 101, the pullout cover 106 is interlocked with, and pulls a pull-out unit 170 out from the apparatus main body 101.

In a state where the pull-out unit 170 is pulled out from the apparatus main body 101, when rotating a first path forming portion 171 and a second path forming portion 172 which are attached to the pull-out unit 170 in the clockwise direction around an axis 173, a guide surface on an inner side of the curved reverse path 151*a* which configures the first discharge path 151 is separated from a guide surface on an outer side, or a guide surface on an outer side of the branch path 160 is separated from a guide surface on an inner side.

Accordingly, as the guide surfaces on the outer sides of the curved reverse path 151*a* and the branch path 160 are respectively separated from the guide surfaces on the inner sides, a state where the inside of the path is open and the paper sheet P that caused paper jamming in the path can be taken out is achieved.

Figure 3:
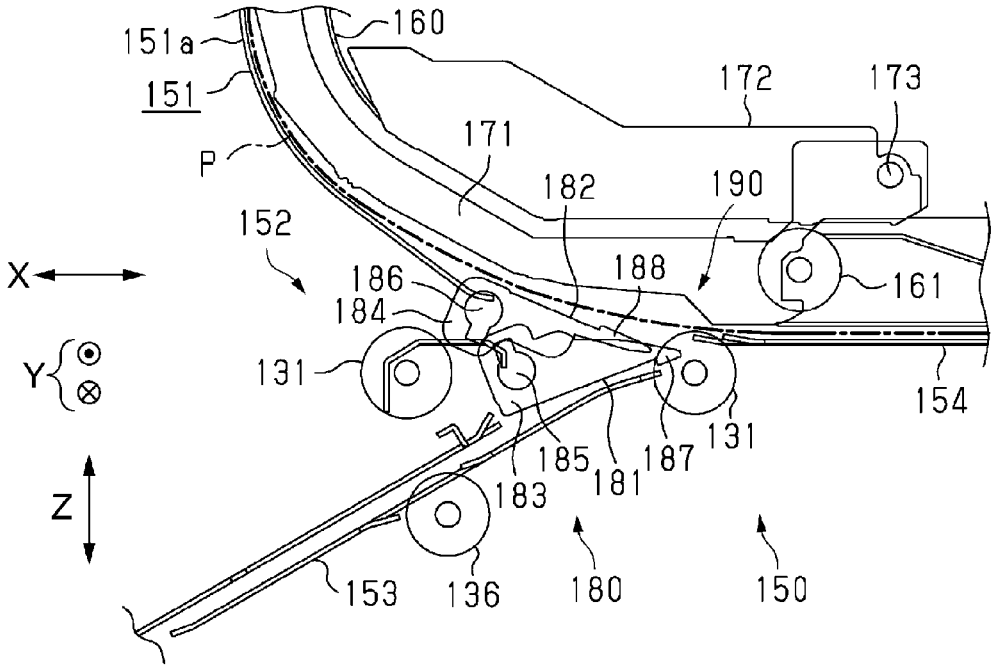
FIG. 3 is an enlarged view illustrating a state of a guiding mechanism.
Figure 4:
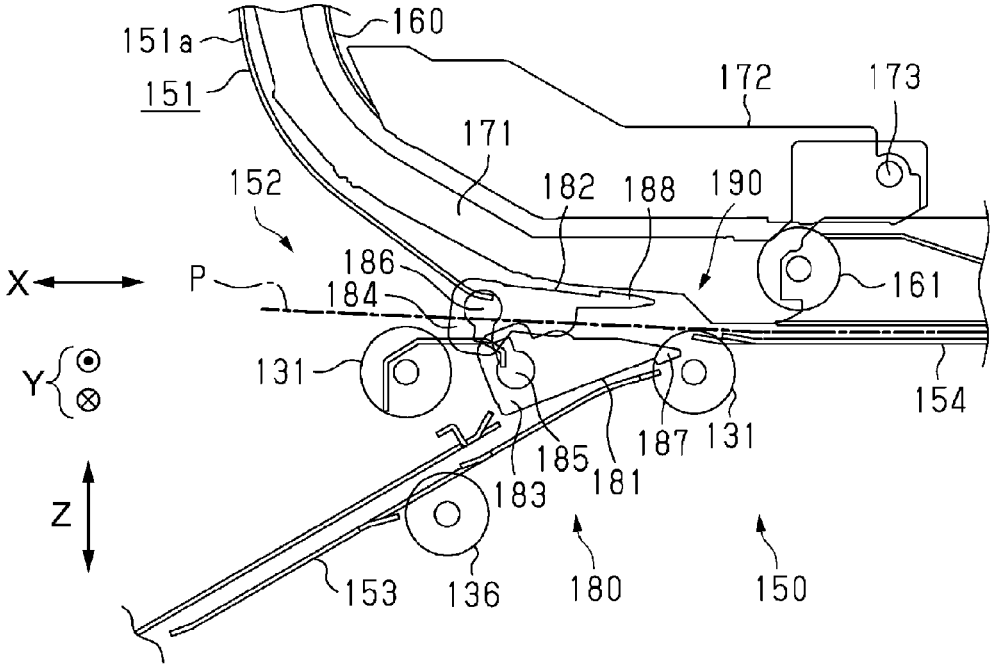
FIG. 4 is an enlarged view illustrating a state of the guiding mechanism.
Figure 5:
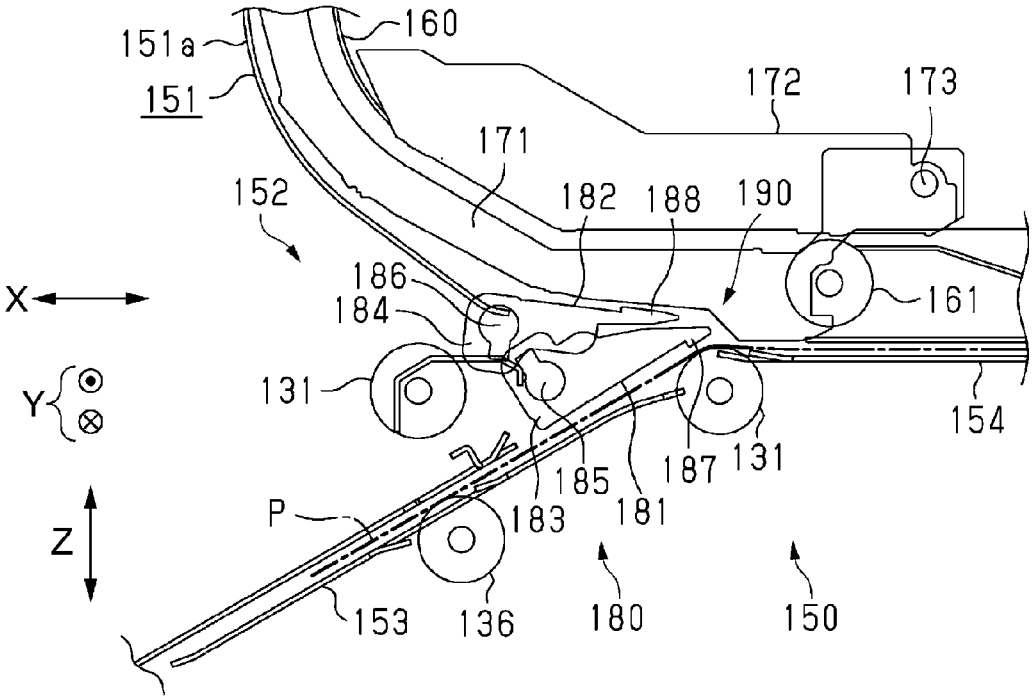
FIG. 5 is an enlarged view illustrating a state of the guiding mechanism.

FIGS. 3, 4, and 5 are enlarged views illustrating a state of the guiding mechanism 180. As illustrated in FIGS. 3 to 5, the guiding mechanism 180 includes a first guiding portion 181 and a second guiding portion 182. Each of the guiding portions 181 and 182 is provided at a branch position 190 which branches to each of the first to the third discharge paths 151, 152, and 153 from the downstream end of the common discharge path 154, and is disposed to be deviated in the leftward-and-rightward direction X which is the transport direction of the paper sheet P from the recording portion 110 so that the first guiding portion 181 is positioned on the right side which is the upstream side and the second guiding portion 182 is positioned on the left side which is the downstream side. In addition, even in the vertical direction Z, each of the guiding portions 181 and 182 is disposed to be deviated so that the first guiding portion 181 is positioned on the lower side and the second guiding portion 182 is positioned on the upper side.

In addition, each of the guiding portions 181 and 182 includes axes 185 and 186 in base end portions 183 and 184 which are a part on the left side that becomes the downstream side in the leftward-and-rightward direction X which is the transport direction, and is provided to be rotatable around each of the axes 185 and 186. Each of the guiding portions 181 and 182 is a part on the right side which becomes the upstream side in the leftward-and-rightward direction X which becomes the transport direction as the guiding portions 181 and 182 rotate around the axes 185 and 186 which are respectively provided in the guiding portions, and positions of tip end portions 187 and 188 which are on a side opposite to the base end portions 183 and 184 are displaced up and down in the vertical direction Z.

Each of the guiding portions 181 and 182 is selectively switched up and down, comes into contact with the paper sheet P transported through the common discharge path 154, and accordingly, guides the paper sheet P to any of the first to the third discharge paths 151, 152, and 153. Meanwhile, each of the guiding portions 181 and 182 is configured not to interrupt the rotation operation each other, for example, not to interfere with each other since the guiding portions 181 and 182 are formed in a shape of comb teeth across the tip end portions 187 and 188 from the base end portions 183 and 184. The rotation operations in each of the guiding portions 181 and 182 are controlled by a control portion which is provided in the printer 100 and is not illustrated.

FIG. 3 illustrates a state when both of the tip end portion 187 of the first guiding portion 181 and the tip end portion 188 of the second guiding portion 182 are positioned at the lower position. At this time, the tip end portion 187 of the first guiding portion 181 is positioned to block the upstream end of the third discharge path 153, and the tip end portion 188 of the second guiding portion 182 is positioned to block the upstream end of the second discharge path 152. Therefore, in the state of FIG. 3, the guiding mechanism 180 guides the paper sheet P transported through the common discharge path 154 to the first discharge path 151.

FIG. 4 illustrates a state when the tip end portion 187 of the first guiding portion 181 is positioned at the lower position, and the tip end portion 188 of the second guiding portion 182 is positioned at the upper position. At this time, the tip end portion 187 of the first guiding portion 181 is positioned to block the upstream end of the third discharge path 153, and the tip end portion 188 of the second guiding portion 182 is positioned to block the upstream end of the first discharge path 151. Therefore, in the state of FIG. 4, the guiding mechanism 180 guides the paper sheet P transported through the common discharge path 154 to the second discharge path 152.

FIG. 5 illustrates a state when both of the tip end portion 187 of the first guiding portion 181 and the tip end portion 188 of the second guiding portion 182 are positioned at the upper position. At this time, the tip end portion 187 of the first guiding portion 181 is positioned to block the upstream end of the first discharge path 151 and the upstream end of the second discharge path 152, and the tip end portion 188 of the second guiding portion 182 is positioned to block the upstream end of the first discharge path 151. Therefore, in the state of FIG. 5, the guiding mechanism 180 guides the paper sheet P transported through the common discharge path 154 to the third discharge path 153.

Next, the first post processing apparatus 200 will be described.

Figure 6:
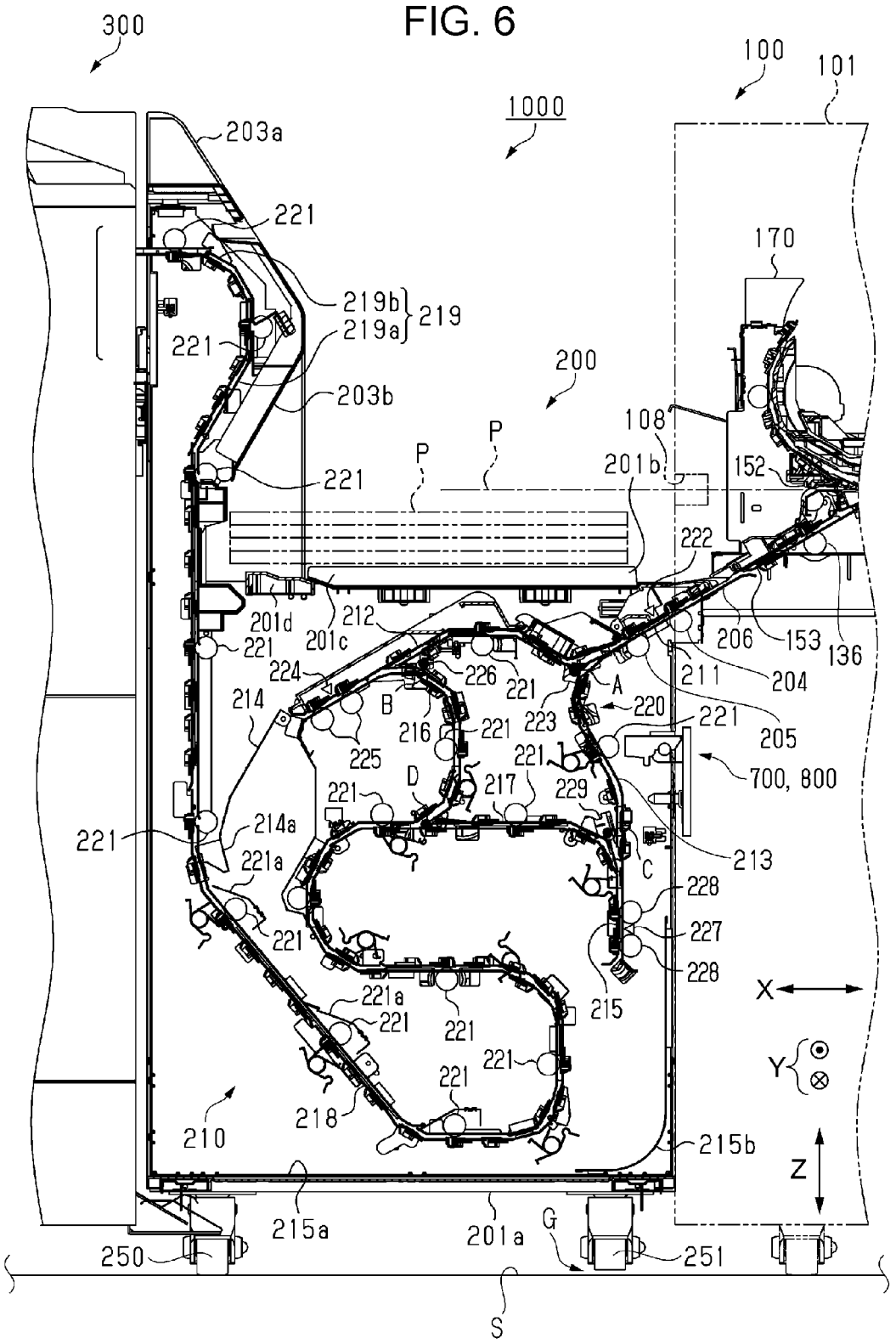
FIG. 6 is a schematic structure view of a first post processing apparatus.

FIG. 6 is a schematic structure view of the first post processing apparatus 200. In the first post processing apparatus 200, an intermediate transport portion 220 which transports the paper sheet P along an intermediate transport path 210 is provided. The intermediate transport path 210 is formed so that the paper sheet P is transported being curved by considering the direction which intersects with the width direction of the medium that is a direction along the forward-and-rearward direction Y as the transport direction.

The intermediate transport portion 220 includes a plurality of intermediate transport roller pairs 221 provided along the intermediate transport path 210. As the intermediate transport roller pairs 221 are driven to be rotated in a state of nipping and supporting the paper sheet P from the both front and rear sides, the paper sheet P is transported along the intermediate transport path 210. It is preferable that an unevenness be formed in an outer circumference in the intermediate transport roller pair 221 in order to suppress adhesion of the ink ejected to the paper sheet P.

The lead-in path 211 which is connected to the downstream end of the third discharge path 153 of the printer 100, and leads the paper sheet P into the first post processing apparatus 200 is provided at the upstream end of the intermediate transport path 210 which is at an upper position in the vertical direction Z in the lead-in portion 202. The lead-in path 211 penetrates the side wall on the left side of the drawing of the apparatus main body 101 of the printer 100 and the side wall on a right side of the drawing of the first post processing apparatus 200, and straightly extends in a diagonally downward orientation which intersects with the vertical direction Z toward the inside of the first post processing apparatus 200 from the apparatus main body 101.

In the lead-in path 211, a guide plate 206 which guides the paper sheet P discharged from the third discharge path 153, and transport roller pairs 204 and 205 which transport the paper sheet P to the downstream side are provided. The transport roller pair 204 is provided further on the upstream side than the transport roller pair 205 in the transport direction.

The tip end portion of the paper sheet P which passes through the discharge roller pair 136 is nipped at a nip position of the transport roller pair 204, and moves to the downstream side. In other words, the paper sheet P discharged by the discharge roller pair 136 is delivered to the transport roller pair 204 and transported to the downstream side.

The intermediate transport path 210 includes the lead-in path 211, the first branch path 212, the second branch path 213, a first switchback path 214, a second switchback path 215, a first joining path 216, a second joining path 217, and a lead-out path 218.

The intermediate transport path 210 branches to the first branch path 212 and the second branch path 213 from a branch point A which is a downstream end of the lead-in path 211. In the lead-in path 211, a sensor 222 which detects the paper sheet P that transports the lead-in path 211 is provided.

A guide flap 223 is provided at the branch point A, and is driven based on a signal which is sent when the sensor 222 detects the paper sheet P, and the position at which the paper sheet P transported through the lead-in path 211 is guided to the first branch path 212 and the position at which the paper sheet P is guided to the second branch path 213 are switched to each other. The paper sheets P which are sequentially transported through the lead-in path 211 are alternately guided to the first branch path 212 and the second branch path 213 by the operation of the guide flap 223.

An upstream end of the first switchback path 214 is connected to the downstream end of the first branch path 212. The first switchback path 214 extends downward after being slightly curved leftward in the drawing from the middle of the path. In the first switchback path 214, a guide 214*a* which supports the transported paper sheet P from the lower side in the vertical direction Z is provided on the downstream side which is further on the downstream side than a curved location.

In the first switchback path 214, in the upstream portion which is further on the upstream side than the curved location, one sensor 224 which detects the paper sheet P transported through the first switchback path 214, and two first reverse roller pairs 225 which can rotate in a normal rotation direction and in a reverse rotation direction, are provided. Two first reverse roller pairs 225 perform the normal rotation driving or the reverse rotation driving based on a signal which is sent when the sensor 224 detects the paper sheet P. Accordingly, the paper sheet P transported through the first switchback path 214 is transported (switched back) after the orientation in which the paper sheet P is transported is reversed by the first reverse roller pair 225.

At the downstream end of the first branch path 212, a first regulation flap 226 which regulates the movement of the paper sheet P to the first branch path 212 from the first switchback path 214 while the movement of the paper sheet P to the first switchback path 214 from the first branch path 212 is allowed, is provided. The first regulation flap 226 is biased to block the downstream end of the first branch path 212 due to a biasing force by the biasing member which is not illustrated.

An upstream end of a second switchback path 215 is connected to the downstream end of the second branch path 213. The second switchback path 215 is provided to extend downward in the vertical direction Z. In the second switchback path 215, the downstream end of the upstream portion including the curved location is open toward the side surface on a right side surface of the drawing of the first post processing apparatus 200.

At the position which opposes the downstream end, a guide portion 215*b* which extends being curved across a bottom surface 215*a* from the side surface on a right side of the drawing of the first post processing apparatus 200 is provided. When the paper sheet P is transported through the second switchback path 215, the tip end of the paper sheet P protrudes from the open downstream end, the tip end of the protruding paper sheet P is guided by the guide portion 215*b*, and is led to the bottom surface 215*a* and a lower part of the downstream end of the first switchback path 214.

The second switchback path 215 is configured to include the guide portion 215*b* and the bottom surface 215*a*. Similar to a case of the first switchback path 214, the length of the second switchback path 215 in the transport direction is configured to be equal to or longer than the medium length in the transport direction of the paper sheet P on which the recording can be performed by the printer 100.

In the upstream portion of the second switchback path 215, at the position which is further on the upstream side than the curved location, one sensor 227 which detects the paper sheet P transported through the second switchback path 215, and two second reverse roller pairs 228 which are rotatable in the normal rotation direction and in the reverse rotation direction, are provided.

Two second reverse roller pairs 228 perform the normal rotation driving or the reverse rotation driving based on the signal which is sent from the sensor 227. Accordingly, the paper sheet P transported through the second switchback path 215 is transported (switched back) after the orientation in which the paper sheet P is transported is reversed by the second reverse roller pair 228.

At the downstream end of the second branch path 213, a second regulation flap 229 which regulates the movement of the paper sheet P to the second branch path 213 from the second switchback path 215 while the movement of the paper sheet P to the second switchback path 215 from the second branch path 213 is allowed, is provided. The second regulation flap 229 is biased to block the downstream end of the second branch path 213 due to the biasing force by the biasing member which is not illustrated.

The first joining path 216 extends downward while being curved to a right side of the drawing from a first connection portion B at which a downstream end of the first branch path 212 and an upstream end of the first switchback path 214 are connected to each other. The second joining path 217 extends while being curved to a left side of the drawing from a second connection point C at which a downstream end of the second branch path 213 and an upstream end of the second switchback path 215 are connected to each other.

The first joining path 216 and the second joining path 217 join with each other at a joining point D which is positioned between the first switchback path 214 and the second switchback path 215.

When the paper sheet P is transported from the first branch path 212 to the first switchback path 214, the first regulation flap 226 is displaced to open the downstream end of the first branch path 212 as the tip end of the paper sheet P comes into contact with the first regulation flap 226. Meanwhile, when the paper sheet P is reversely transported (switched back) from the first switchback path 214, the paper sheet P is regulated not to be transported to the first branch path 212 by the first regulation flap 226, and the paper sheet P is guided to the first joining path 216.

When the paper sheet P is transported to the second switchback path 215 from the second branch path 213, the second regulation flap 229 is displaced to open the downstream end of the second branch path 213 as the tip end of the paper sheet P comes into contact with the second regulation flap 229. Meanwhile, when the paper sheet P is reversely transported (switched back) from the second switchback path 215, the paper sheet P is regulated not to be transported to the second branch path 213 by the second regulation flap 229, and the paper sheet P is guided to the second joining path 217.

An upstream end of a lead-out path 218 is connected to the joining point D at which the downstream end of the first joining path 216 and the downstream end of the second joining path 217 are connected to each other. The lead-out path 218 detours to go around the lower side of the downstream end of the first switchback path 214, and extends to an upper portion of the lead-out portion 203, after extending downward being curved to pass through between the first switchback path 214 and the second switchback path 215 toward the second post processing apparatus 300.

The downstream end of the lead-out path 218 penetrates the side wall on the left side of the drawing in the first post processing apparatus 200, and extends toward the second post processing apparatus 300. In the intermediate transport roller pair 221 provided in the lead-out path 218, that is, in the intermediate transport roller pair 221 which opposes the first switchback path 214, a cover 221*a* is provided on the first switchback path 214 side. Accordingly, the paper sheet P transported through the first switchback path 214 is prevented from coming into contact with the intermediate transport roller pair 221 of the lead-out path 218.

The lead-out path 218 includes a linking path 219 which is disposed on the inside of the extending portion 203*a*, and is linked to the second post processing apparatus 300. The linking path 219 includes a first part 219*a* which is curved on the printer 100 side above the recess portion 203*b*, and a second part 219*b* which is curved on the second post processing apparatus 300 side further on the downstream side than and above the first part 219*a*. The downstream end of the second part 219*b* is connected to the transport path (not illustrated) in the second post processing apparatus 300. A part of the upper surface portion 201*b* is disposed below the first part 219*a*.

In this manner, the posture of the paper sheet P on which the recording is performed by the printer 100 is reversed by the first post processing apparatus 200, and the paper sheet P is transported to the second post processing apparatus 300 in a state where the recording surface is oriented toward the lower side in the vertical direction Z when the simplex printing is performed. In addition, at this time, since it is not preferable that the paper sheet P is transported to the second post processing apparatus 300 in a state where the curl is generated in the paper sheet P, the length of the intermediate transport path 210 in the first post processing apparatus 200 is ensured in the transport direction of the paper sheet P by making the path curved and extend to meander.

Here, it is known that the curl of the paper sheet P generated as the ink dispensed from the recording head 111 adheres to the paper sheet P, is gradually settled as time elapses. Therefore, by ensuring the length of the intermediate transport path 210, the first post processing apparatus 200 ensures time which is required until the degree of the curl generated in the paper sheet P becomes equal to or less than a predetermined degree, as time which is required for transporting the paper sheet P through the intermediate transport path 210.

In particular, since the printing is performed at a high speed onto the paper sheet P by the line head type recording head 111, and the transporting is performed at a high speed, there is a possibility that the paper sheet P is transported without being sufficiently dried. In other words, there is a concern that the paper sheet P is transported to the second post processing apparatus 300 in a state where the curl is not sufficiently settled, and the post processing cannot be correctly performed. However, when the transport speed is decreased in the intermediate transport path 210 for ensuring the drying time, the entire throughput decreases since the paper sheet P transported at a high speed when the recording is performed is separated from the paper sheet which is previously transported through the intermediate transport path 210 so as not to collide with the previous paper sheet P. In particular, there is a possibility that the following paper sheet P collides with the previous paper sheet P in the middle of the post processing with respect to the previous paper sheet P.

Here, in the first post processing apparatus 200, as the plurality of switchback paths, such as the above-described first switchback path 214 and the second switchback path 215, are provided, it is possible to ensure the length of the intermediate transport path 210 and to provide the drying time while suppressing an increase in size of the inside of the first post processing apparatus 200. In addition, it is possible to perform the recording on the paper sheet P without both unnecessary increase in distance between the paper sheets and deterioration of the throughput. In addition, as described above, by using the shape of the path which is curved and extends to meander as the shape of the intermediate transport path 210, it is possible to further gain the drying time.

Figure 7:
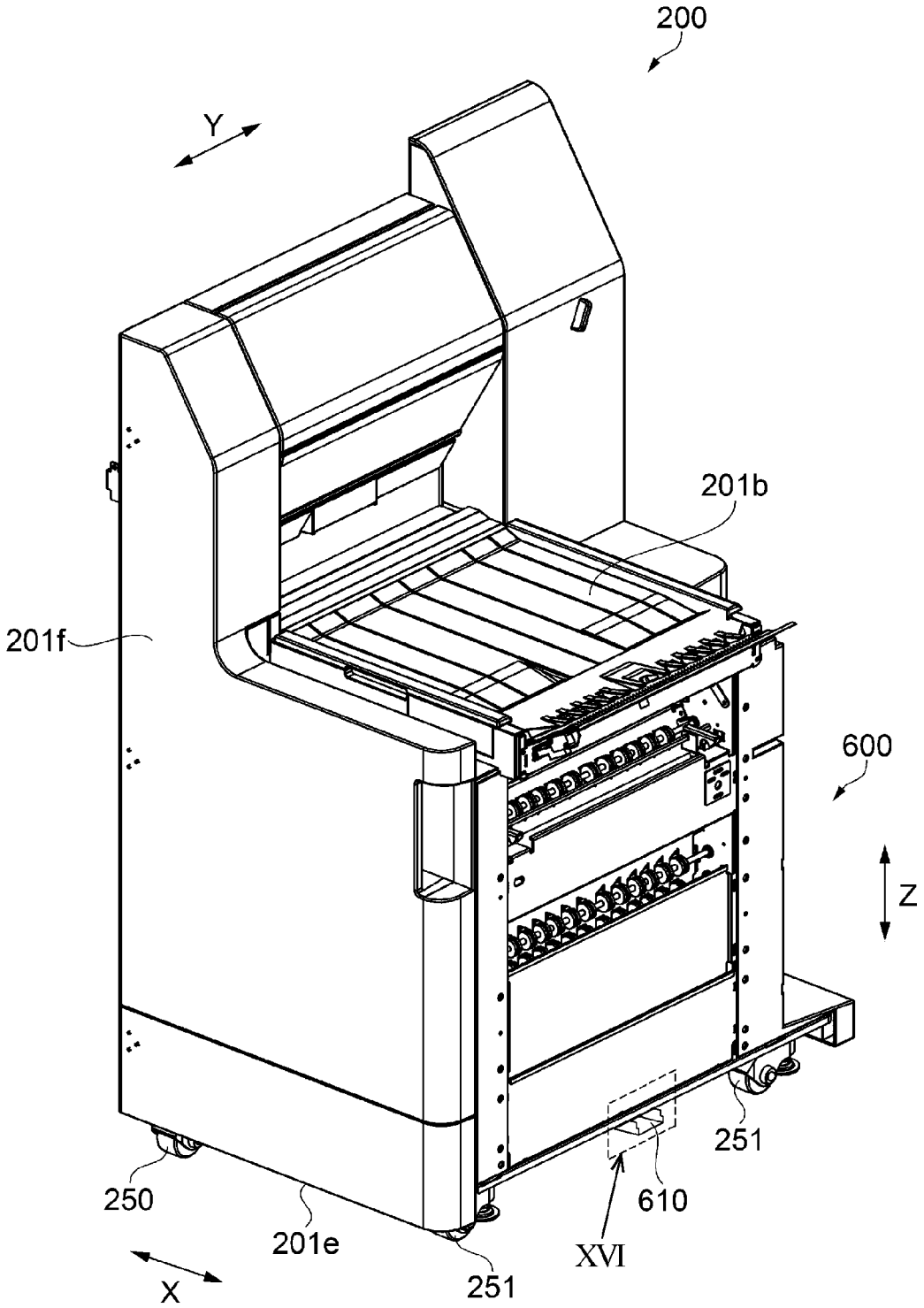
FIG. 7 is an outer perspective view of the first post processing apparatus.

Next, a configuration in which the printer 100 and the first post processing apparatus 200 are linked to each other will be described. FIG. 7 is an external perspective view of the first post processing apparatus 200. On the front side on a side linked to the second post processing apparatus 300 (refer to FIG. 1) in a bottom portion 201*e* of a housing 600, a caster 250 is provided. On a rear side on a side linked to the second post processing apparatus 300 in the bottom portion 201*e* of the housing 600, a caster which is not illustrated and has a configuration that is the same as that of the caster 250 is provided.

On the front side and on the rear side on a side linked to the printer 100 in the bottom portion 201*e*, a caster 251 is provided. The casters 250 and 251 are rollers which are rotatable in the horizontal direction while being supported by an axial portion of which an axial direction is the vertical direction Z.

On the front side on a side linked to the printer 100 in the bottom portion 201*e* of the housing 600, a second abutting member 610 is provided. A position of the second abutting member 610 in the leftward-and-rightward direction X which is a direction in which a housing 500 (refer to FIG. 11) and the housing 600 are aligned is regulated.

Figure 8:
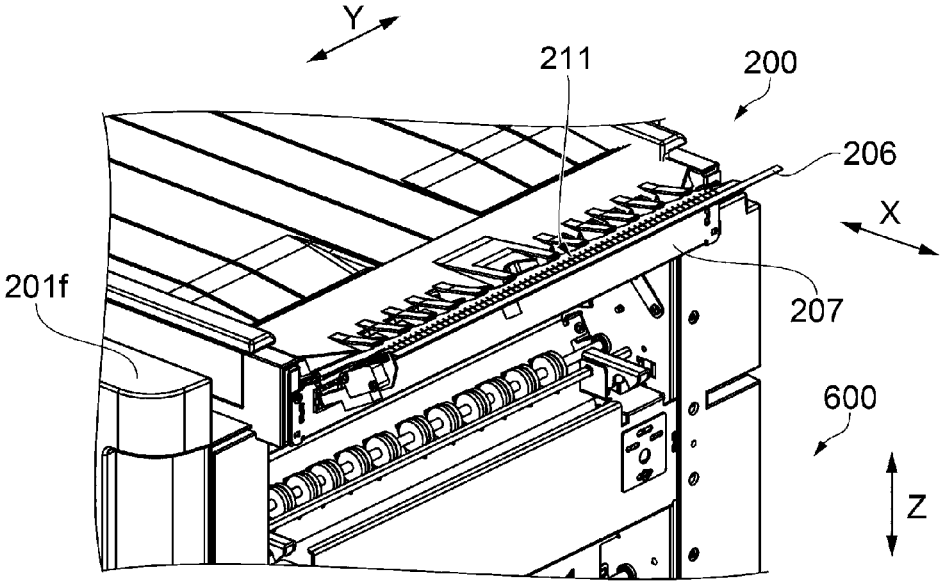
FIG. 8 is an enlarged view of a side surface on a side linked to the printer of the first post processing apparatus.

FIG. 8 is an enlarged view of a side surface on a side linked to the printer 100 of the first post processing apparatus 200. In an upper portion of the first post processing apparatus 200, the lead-in path 211 provided with the above-described guide plate 206 (refer to FIG. 6) is provided, and at a lower part of the guide plate 206, a cover 207 is provided.

Figure 9:
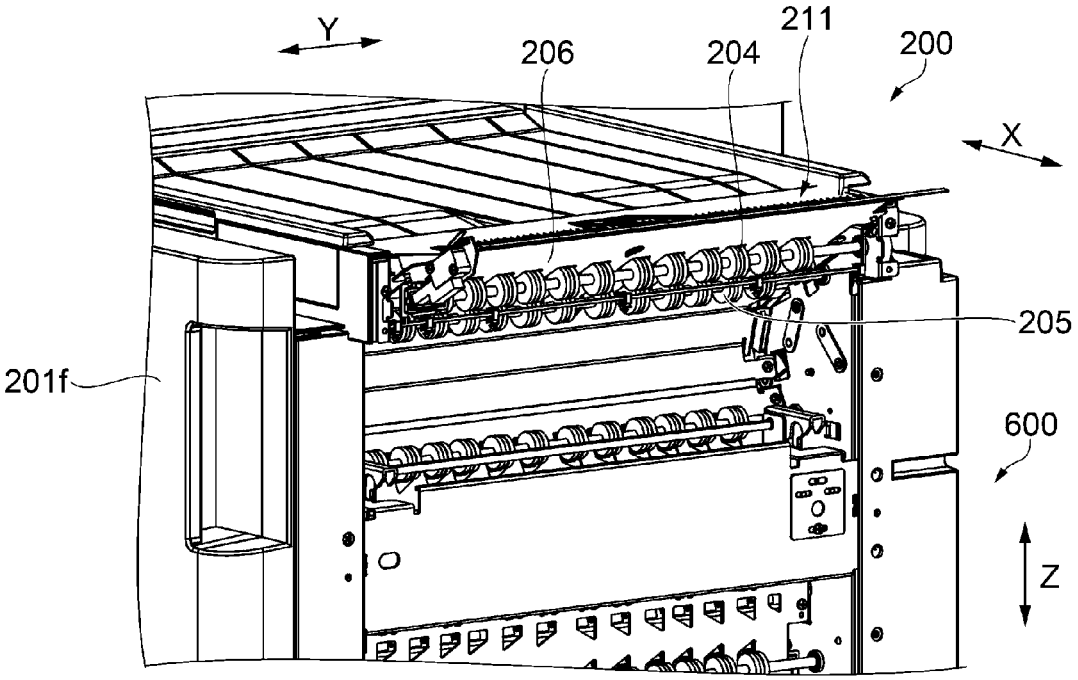
FIG. 9 is an enlarged view of a side surface on the side linked to the printer of the first post processing apparatus.

FIG. 9 is an enlarged view of a side surface on a side linked to the printer 100 of the first post processing apparatus 200 in a state where the cover 207 of FIG. 8 is detached. When detaching the cover 207, the above-described transport roller pairs 204 and 205 (refer to FIG. 6) are exposed.

Figure 10:
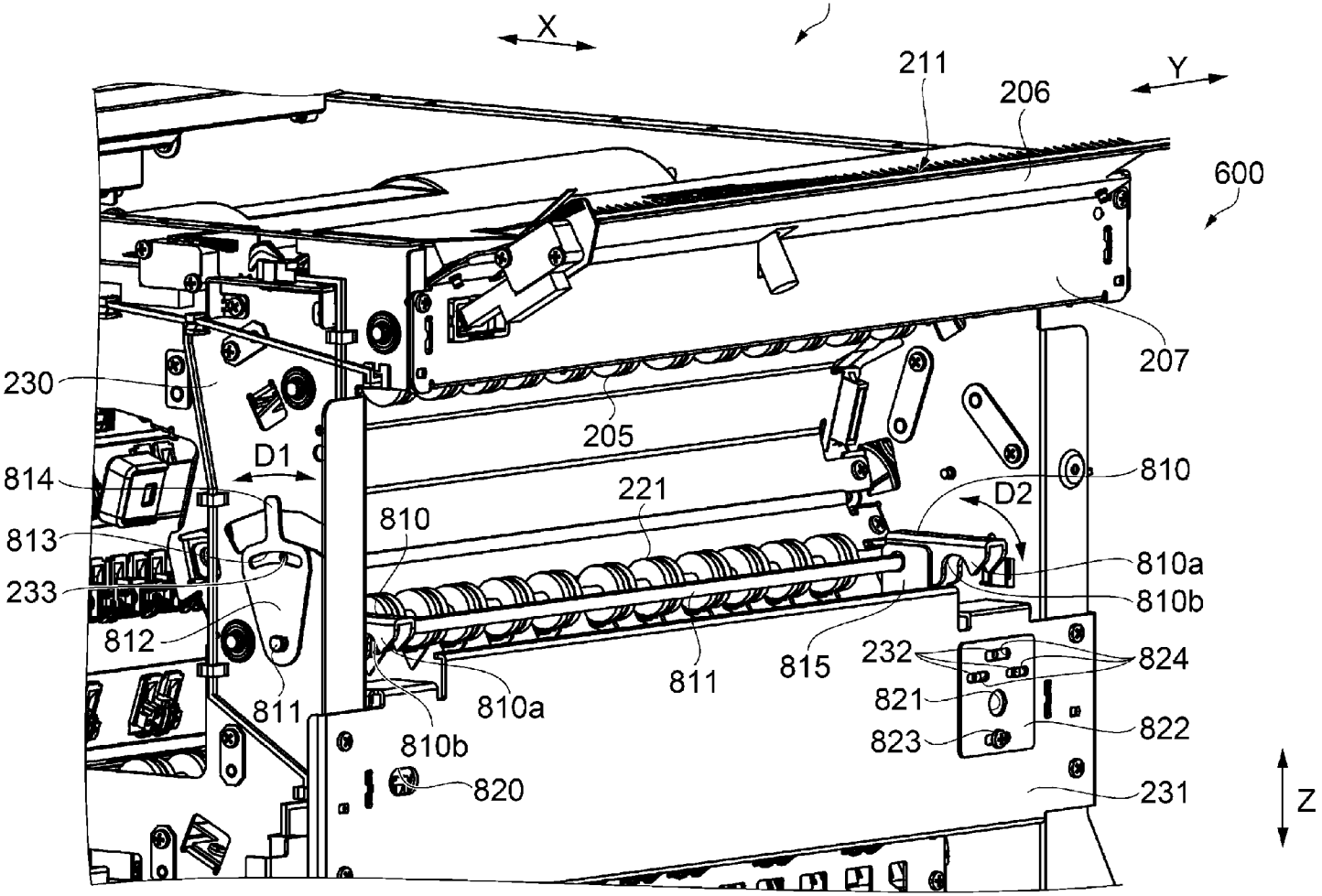
FIG. 10 is an enlarged view of a side surface on the side linked to the printer of the first post processing apparatus.

FIG. 10 is an enlarged view of a side surface on a side linked to the printer 100 of the first post processing apparatus 200, and illustrates a state where a side surface cover 201*f* of FIG. 7 is detached. The housing 600 is configured of a plurality of frames including a frame 231 that extends in the forward-and-rearward direction Y.

A hole portion 820 is formed on the front side (left side of the drawing) in the forward-and-rearward direction Y in the frame 231. A plate-like member 822 in which a hole portion 821 is formed is fixed to the rear side (right side of the drawing) in the forward-and-rearward direction Y in the frame 231 by a screw 823.

As three projection portions 232 formed in the frame 231 are respectively fitted to three long holes 824 formed in the plate-like member 822, a position of the plate-like member 822 in the vertical direction Z and in the forward-and-rearward direction Y with respect to the frame 231 is regulated.

Above the frame 231, one pair of hooks 810 which are fixed to both sides of a rod-like member 811 that extends in the forward-and-rearward direction Y, and are rotatable in a rotational direction D2 is provided. The hook 810 includes a protrusion portion 810*a* of which a tip end side protrudes in the rotational direction D2, and a recess portion 810*b* which is cut out in an arc shape.

The rod-like member 811 is supported to be freely rotatable by a support portion 815 on a rear side in the forward-and-rearward direction Y fixed to the housing 600 and a support portion (not illustrated) on a front side. A lever 812 in which a grip portion 814 is formed is fixed to the end portion on the front side (left side of the drawing) of the rod-like member 811.

In the lever 812, a long hole 813 formed to be long in an arc shape is formed, and in a state where a projected portion 233 provided in a frame 230 is inserted in the long hole 813, the lever 812 is rotatable considering the rod-like member 811 as a fulcrum.

When the user grips the grip portion 814 and rotates the lever 812 in a rotational direction D1, the rod-like member 811 rotates, and the hook 810 rotates in the rotational direction D2 being interlocked therewith.

Figure 11:
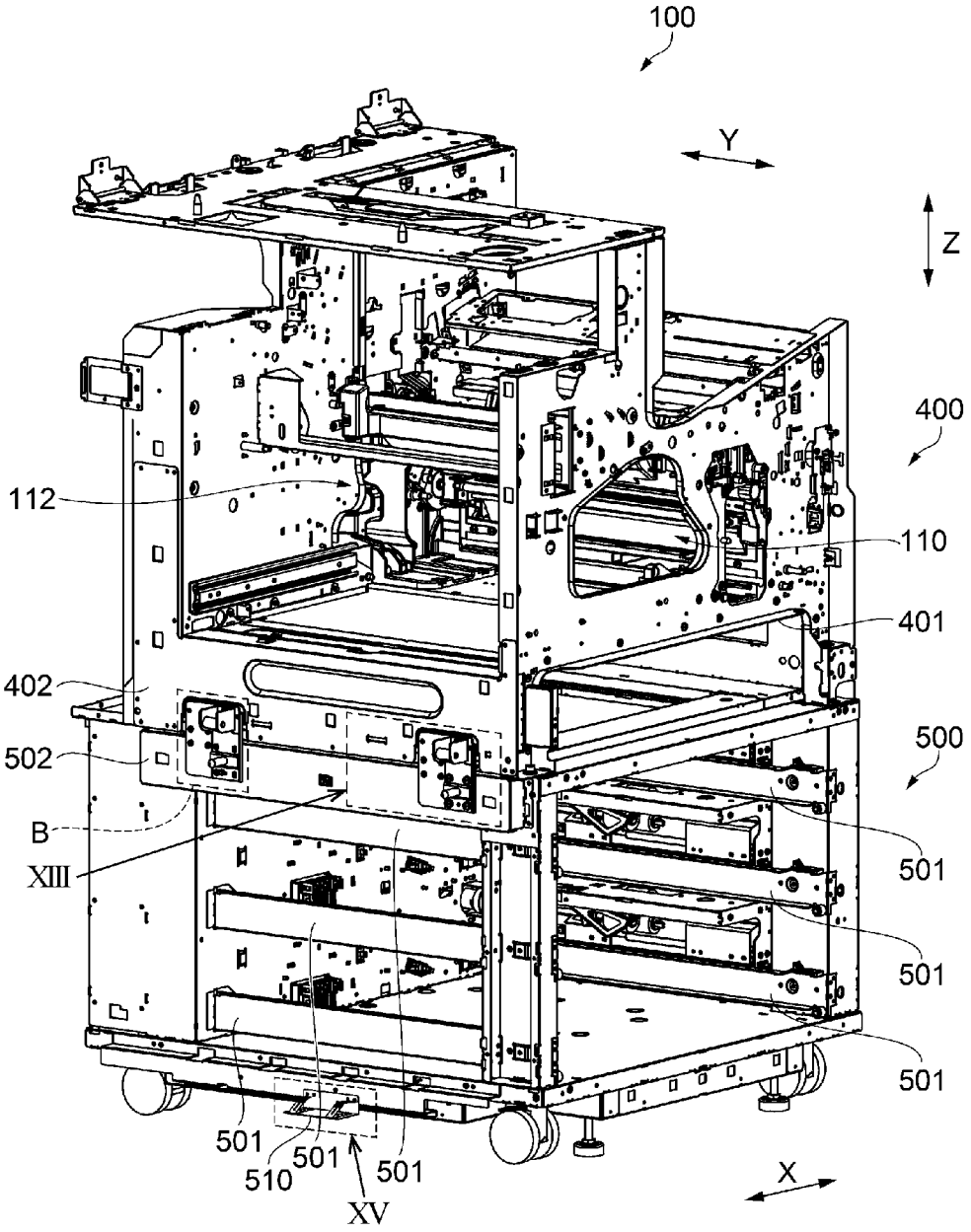
FIG. 11 is a perspective view of a housing of the printer.

FIG. 11 is a perspective view of housings 400 and 500 of the printer 100 of FIG. 1. FIG. 11 illustrates a state where the housing 400 is loaded above the housing 500. The housings 400 and 500 are box-shaped structure bodies which are configured as a plurality of metal frames are combined.

On the outer sides of the housings 400 and 500, the exterior cover 105, the front plate cover 104, the pullout cover 106, and the operation portion 102 in FIG. 1 are mounted.

In addition, below the housing 500, a first abutting member 510 is provided in the metal frame on the front side on a side linked to the first post processing apparatus 200. As the first abutting member 510 abuts against the second abutting member 610 provided in the housing 600 of the above-described first post processing apparatus 200, the position in the leftward-and-rightward direction X which is the direction in which the housing 500 and the housing 600 are aligned is regulated.

On an opening portion 401 provided in the housing 400 of FIG. 11, the uppermost paper cassette 103 among the four paper cassettes of FIG. 1 is mounted. On a frame 501 which is provided in the housing 500 and extends in the forward-and-rearward direction Y, the remaining three paper cassettes 103 of FIG. 1 are mounted.

The recording portion 110 is held by a frame structure body 112 configured as the plurality of frames are combined. The frame structure body 112 is held on an inner side of the housing 400.

A load of the recording portion 110, the frame structure body 112, or the transport portion 130, which is accommodated in the housing 400 and a load of the housing 400 itself, are applied to the housing 500.

Figure 12:
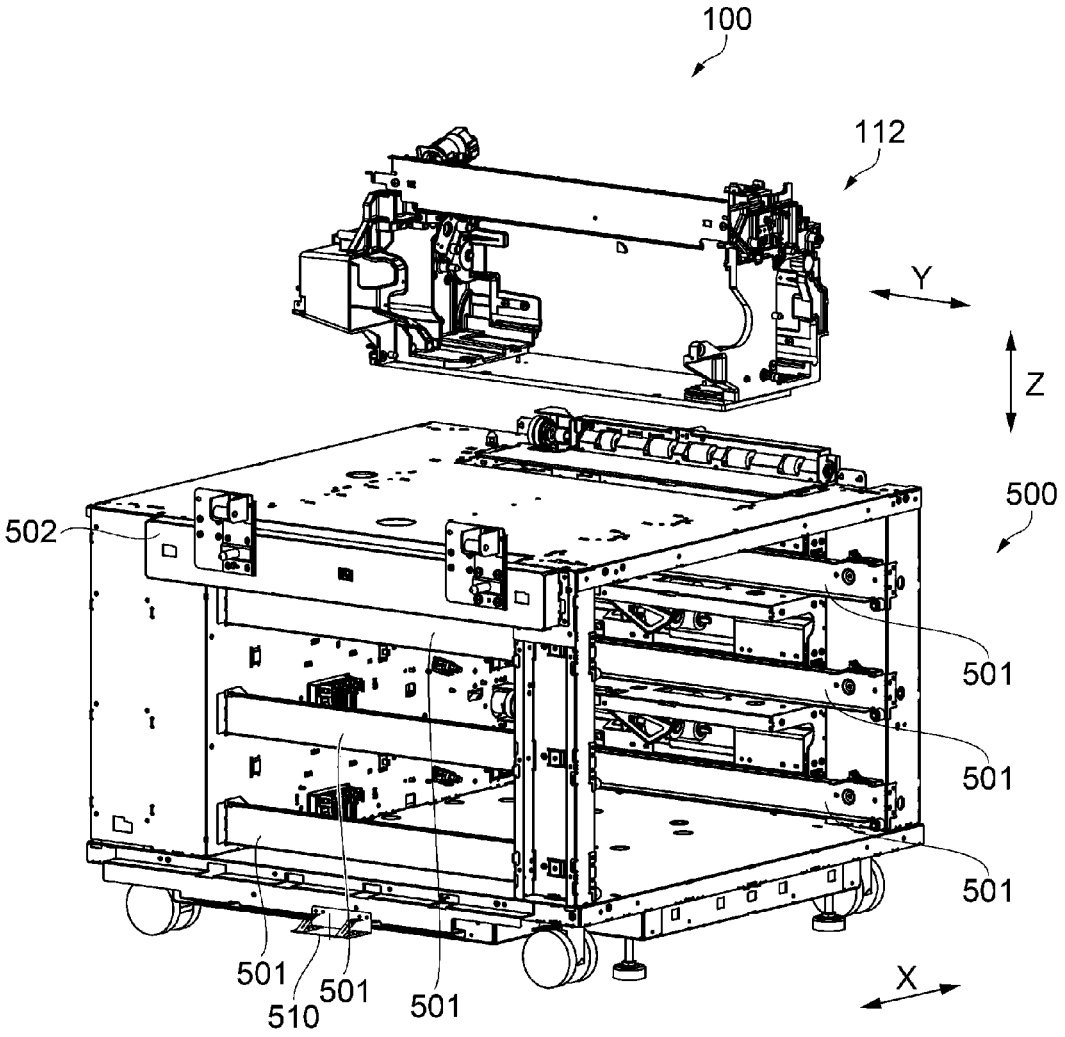
FIG. 12 is a perspective view of a frame structure body and the housing.

FIG. 12 is a perspective view of the frame structure body 112 and the housing 500, and illustrates a state where the housing 400 and the recording portion 110 are removed from FIG. 11. The housing 400 and the housing 500 are respectively and independently configured, and can be separated.

Figure 13:
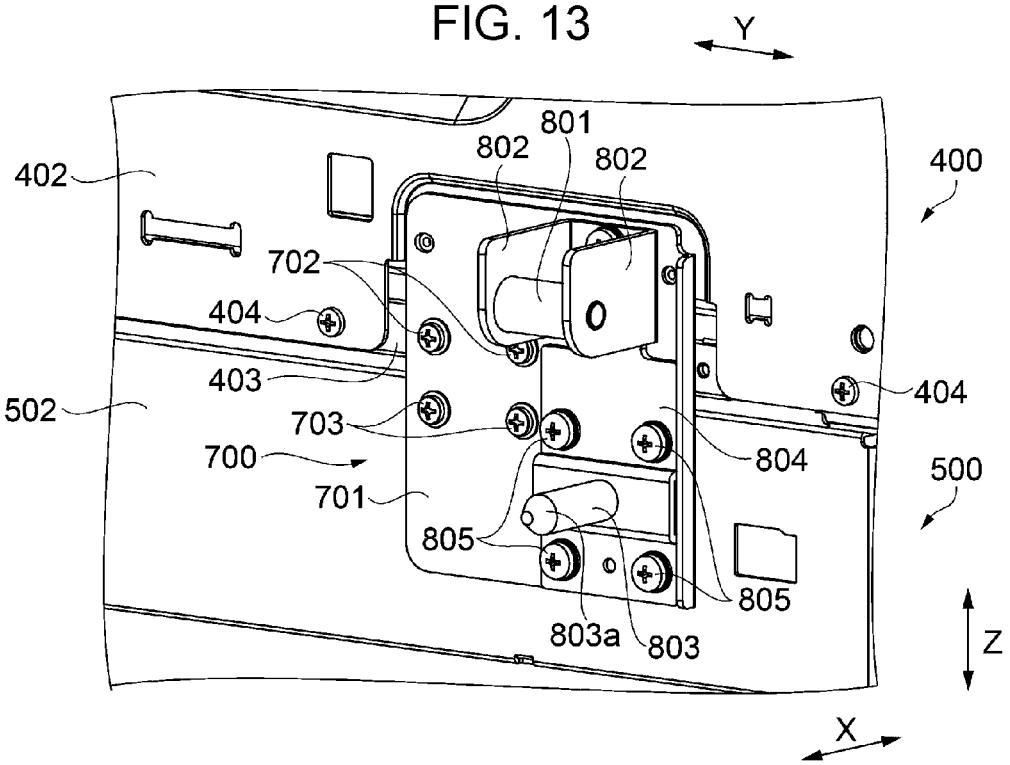
FIG. 13 is a perspective view in which a part to which a member that configures a first linking portion and a second linking portion is attached is enlarged.

FIG. 13 is a perspective view in which a part (a part surrounded by a broken line XIII of FIG. 11) to which a member that configures a first linking portion 700 and a second linking portion 800 of FIG. 11 is attached is enlarged. Frames 402 and 403 are included in the plurality of frames that configure the housing 400. The frame 402 and the frame 403 are combined by a screw 404 or the like. A frame 502 is included in the plurality of frames that configure the housing 500.

One pair of screws 702 passes through a plate-like member 701 and is screwed to the frame 402 that configures the housing 400. One pair of screws 703 passes through the plate-like member 701 and is screwed to the frame 502 that configures the housing 500.

The first linking portion 700 is configured of the plate-like members 701 and the screws 702 and 703. The first linking portion 700 regulates the position of the housing 500 with respect to the housing 400, and links the housing 400 and the housing 500 to each other.

A plate-like member 804 is fixed to the housing 500 by four screws 805 which pass through the plate-like member 701. The plate-like member 804 is not fixed to the housing 400. In the plate-like member 804, one pair of support portions 802 which protrudes in the leftward-and-rightward direction X from the plate-like member 804 is provided, and both end portions of a columnar member 801 are fixed to one pair of support portions 802. The direction of the center axis of the columnar member 801 is the forward-and-rearward direction Y.

Below the columnar member 801, a protrusion portion 803 which has a columnar shape and protrudes in the leftward-and-rightward direction X is fixed to the plate-like member 804.

On a left side of the drawing (a part surrounded by a broken line B) in the forward-and-rearward direction Y of FIG. 11, as described above, the first linking portion 700 which links the housing 400 and the housing 500 to each other by the plate-like member 701, the plate-like member 804 fixed to the housing 500, the support portion 802 and the protrusion portion 803 which are fixed to the plate-like member 804, and the columnar member 801 fixed to the support portion 802 are also respectively similarly configured.

Figure 14:
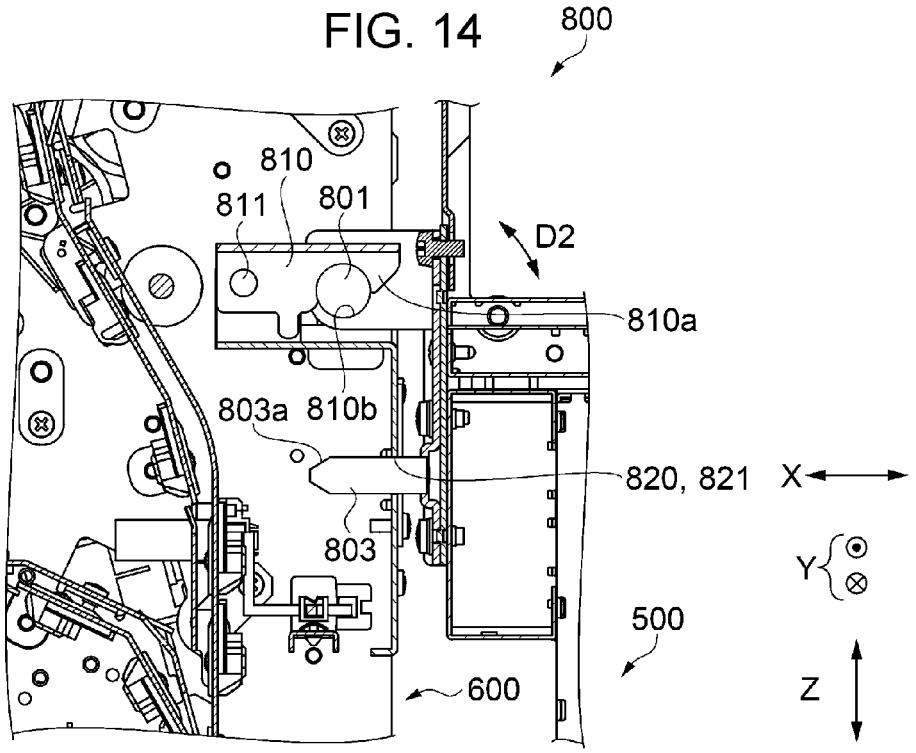
FIG. 14 is a sectional view of a state where the housing is liked by the second linking portion.

FIG. 14 is a sectional view in which a state where the housing 500 and the housing 600 are linked to each other by the second linking portion 800 is viewed from the forward-and-rearward direction Y. In the hook 810, half of the upper side of the columnar member 801 intrudes to the recess portion 810*b*, and the protrusion portion 810*a* is at a rotation position which abuts against the outer circumferential surface of the columnar member 801. In this state, the movement in the leftward-and-rightward direction X of the columnar member 801 is regulated by the hook 810. In other words, a state where the housing 600 is linked by the second linking portion 800 and the movement in the leftward-and-rightward direction X is regulated, is achieved.

When the lever 812 of FIG. 10 is rotated in the counterclockwise direction in the rotational direction D1, a state where the hook 810 of FIG. 14 rotates in the counterclockwise direction in the rotational direction D2 considering the rod-like member 811 as a fulcrum and the hook 810 is engaged with the columnar member 801, is achieved.

As illustrated in FIG. 14, the protrusion portion 803 is engaged with each of the hole portions 820 and 821. The protrusion portion 803 which is in a state of being separated from the hole portions 820 and 821 is guided by a tip end portion 803*a* formed in a conical shape when being inserted into the hole portions 820 and 821. In a state where the protrusion portion 803 is fitted to the hole portions 820 and 821, the position of the housing 600 with respect to the housing 500 is regulated.

The second linking portion 800 is configured of the hook 810 and the hole portions 820 and 821 which are provided in the housing 600 of FIG. 10, and the columnar member 801 and the protrusion portion 803 which are provided in the housing 500 of FIG. 13.

As the protrusion portion 803 of FIG. 14 is fitted to the hole portions 820 and 821, the position of the housing 600 with respect to the housing 500 is regulated, and a load applied from the housing 600 is applied to the housing 500 via the protrusion portion 803 and the hole portions 820 and 821.

As illustrated in FIG. 6, the first linking portion 700 and the second linking portion 800 are provided at a position below the lead-in path 211.

In a state where the protrusion portion 803 of FIG. 14 is fitted to the hole portions 820 and 821, the caster 250 of FIG. 6 is in contact with an installation surface S, a void G is formed between the caster 251 and the installation surface S, and the caster 251 does not abut against the installation surface S. Accordingly, in a state where the protrusion portion 803 of FIG. 14 is fitted to the hole portions 820 and 821, the first post processing apparatus 200 is supported by the caster 250 and the hole portions 820 and 821 into which protrusion portion 803 are inserted.

Therefore, the weight of the first post processing apparatus 200 including the intermediate transport portion 220 or the housing 600 is applied to the caster 250 as a load received from the housing 600, and is applied to the housing 500 via the protrusion portion 803 inserted into the hole portions 820 and 821.

In addition, when viewed from the forward-and-rearward direction Y, using the caster 250 as a fulcrum, the first post processing apparatus 200 which falls to the housing 500 side is in a state of a posture stopped at a positions of the hole portions 820 and 821 to which the protrusion portion 803 is fitted. Therefore, the position of the housing 600 with respect to the housing 500 is regulated by the positions of the hole portions 820 and 821 to which the protrusion portion 803 is fitted.

Next, an abutting portion 1100 at which the housing 500 and the housing 600 abut against each other will be described with reference to FIGS. 15 to 17.

Figure 15:
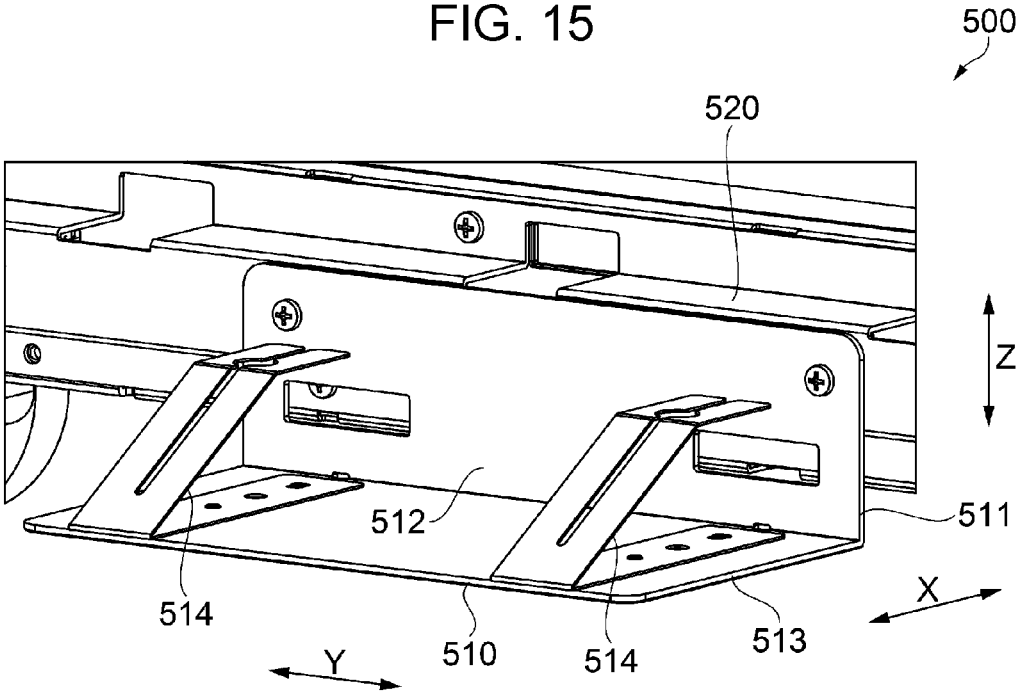
FIG. 15 is an enlarged view of a part to which a first abutting member of the housing of the printer is attached.

FIG. 15 is a perspective view in which a part (a part surrounded by a broken line XV of FIG. 11) to which the first abutting member 510 of FIG. 11 is attached is enlarged. The first abutting member 510 is attached to the metal frame of the housing 500 via an attaching member 520 at a position which opposes the housing 600 of the first post processing apparatus 200 further at a lower part than the first linking portion 700 and the second linking portion 800 of the housing 500. In other words, the metal frame of the housing 500 and the attaching member 520, and the attaching member 520 and the first abutting member 510, are fixed to each other by a plurality of screws or the like.

The first abutting member 510 includes: an abutting portion 511 including an abutting surface 512 which is parallel to the frame 402 that configures the housing 400 or the frame 502 that configures the housing 500, and an overhang portion 513 which is overhung to the housing 600 side from the abutting portion 511, that is, extends in the leftward-and-rightward direction X.

A conduction member 514 is fixed by a bonding screw or the like or bonded by welding or the like to the overhang portion 513 on a surface (upper surface side) on the abutting surface 512 side of the overhang portion 513.

After extending to the housing 600 side on the overhang portion 513, the conduction member 514 is folded back at an acute angle on the abutting portion 511 side, and its tip portion is formed to be substantially parallel to a surface of the overhang portion 513, and the tip end portion of the conduction member 514 is separated from the overhang portion 513. Since the conduction member 514 is folded back at an acute angle on the abutting portion 511 side and is formed, the conduction member 514 has elasticity (spring characteristics) in the vertical direction Z which is the direction that intersects with the surface of the overhang portion 513.

The frame of the housing 500, the first abutting member 510, the attaching member 520, and the conduction member 514, are configured of a conductive member. Therefore, the frame of the housing 500, the first abutting member 510, and the conduction member 514 are electrically conducted.

Figure 16:
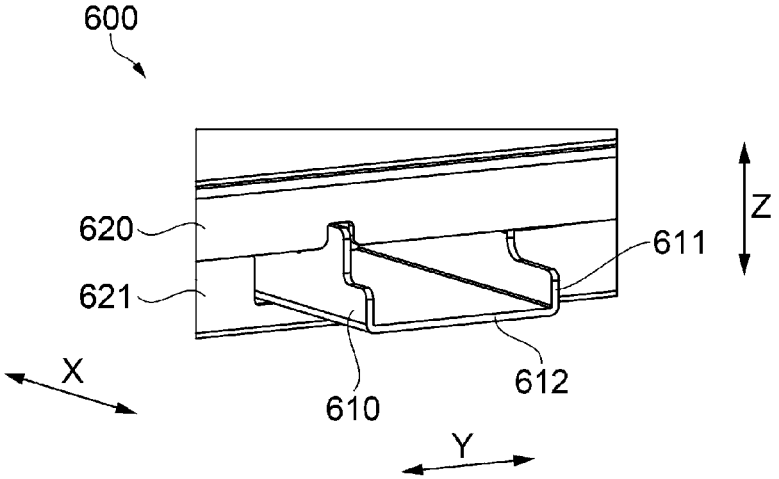
FIG. 16 is an enlarged view of a part to which a second abutting member of the first post processing apparatus is attached.

FIG. 16 is a perspective view in which a part (a part surrounded by a broken line XVI of FIG. 7) to which the second abutting member 610 of FIG. 7 is attached is enlarged. The second abutting member 610 is attached to the bottom portion 201*e* of the housing 600 via an attaching member 620 at a position which opposes the first abutting member 510 attached to the housing 500 of the printer 100 below the housing 600. In other words, the bottom portion 201*e* and the attaching member 620, and the attaching member 620 and the second abutting member 610, are fixed by the plurality of screws or the like.

The second abutting member 610 includes an abutting portion 611 which extends to the printer 100 side from the housing 600 side. In the abutting portion 611, an abutting surface 612 which opposes the abutting surface 512 of the first abutting member 510 is provided, and when the printer 100 and the first post processing apparatus 200 are linked to each other, the abutting surface 512 of the first abutting member 510 and the abutting surface 612 of the second abutting member 610 abut against each other.

Both ends in the forward-and-rearward direction Y of the second abutting member 610 are respectively formed in a shape of folding back to be substantially perpendicular to the vertical direction Z (upper part in the vertical direction Z) which is the housing 600 side. By such a shape, compared to the shape of a flat plate, it is possible to improve strength in the leftward-and-rightward direction X, and to reduce deformation caused by an external force from the leftward-and-rightward direction X of the second abutting member 610.

In addition, in the second abutting member 610, the housing 600 side is open and a part on a side opposite to the abutting portion 611 is covered with a box-like cover 621 having an opening portion on the printer 100 side to be linked. In addition, the cover 621 is fixed to the attaching member 620 by the plurality of screws or the like.

The frame of the housing 600, the bottom portion 201*e*, the second abutting member 610, the attaching member 620, and the cover 621 are configured of a conductive member. Therefore, the frame of the housing 600, the second abutting member 610, and the cover 621 are electrically conducted.

Figure 17:
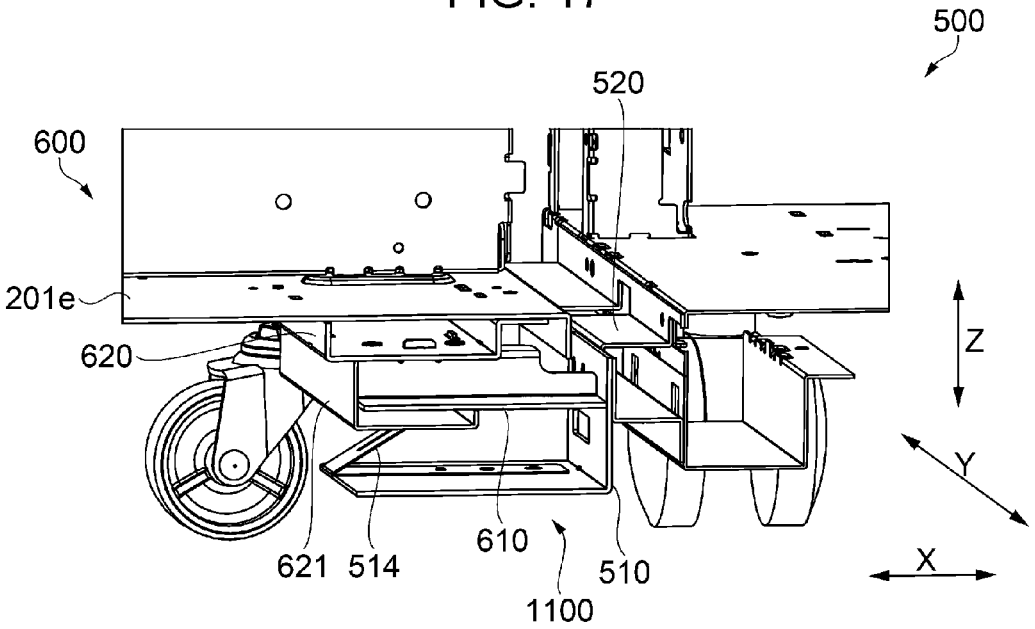
FIG. 17 is a sectional perspective view in a state where the housing of the printer and the housing of the first post processing apparatus abut against each other by an abutting portion.

FIG. 17 is a perspective view of a section when a state where the housing 500 and the housing 600 abut against each other by the abutting portion 1100 is viewed from the forward-and-rearward direction Y. The abutting portion 1100 is configured of the first abutting member 510 provided in the housing 500 of the printer 100, and the second abutting member 610 provided in the housing 600 of the first post processing apparatus 200.

In a state where the housing 500 and the housing 600 are linked to each other by the second linking portion 800, the abutting surface 612 of the second abutting member 610 provided in the housing 600 abuts against the abutting surface 512 of the first abutting member 510 provided in the housing 500. As the first abutting member 510 and the second abutting member 610 abut against each other, the position in the leftward-and-rightward direction X which is the direction in which the housing 500 and the housing 600 are aligned is regulated.

In addition, as the first abutting member 510 and the second abutting member 610 abut against each other, the overhang portion 513 provided in the first abutting member 510 is inserted into a lower part of the housing 600, and the conduction member 514 disposed in the overhang portion 513 is disposed below the cover 621 that covers the second abutting member 610. Here, the length in the vertical direction Z which is the height of the conduction member 514 is designed to be longer (higher) than the length in the vertical direction Z which is an interval between the overhang portion 513 and the cover 621.

Therefore, when the conduction member 514 is inserted into a lower part of the cover 621, the conduction member 514 is pushed downward by the cover 621. However, since the conduction member 514 has elasticity in the vertical direction Z, the tip end portion of the conduction member 514 comes into contact with the cover 621 by a vertical repulsive force, the conduction member 514 and the cover 621 are conductive members, and thus, the conduction member 514 and the cover 621 can be electrically conducted, the housing 500 and the housing 600 can be conducted, and influence, such as electric noise, can be reduced.

In addition, in the embodiment, the electric conduction is achieved as a configuration in which the conduction member 514 comes into contact with the cover 621, but the disclosure is not limited thereto, and a configuration which achieves electric conduction as the conduction member 514 comes into contact with the second abutting member 610, the attaching member 620, or the bottom portion 201*e* may also be employed.

In addition, by using the elasticity of the conduction member 514, the electric conduction with the cover 621 is achieved, but the disclosure is not limited thereto, and a configuration which achieves electric conduction as the tip end portion of the conduction member 514 is fixed to the cover 621 by the metal screw may also be employed.

Figure 18:
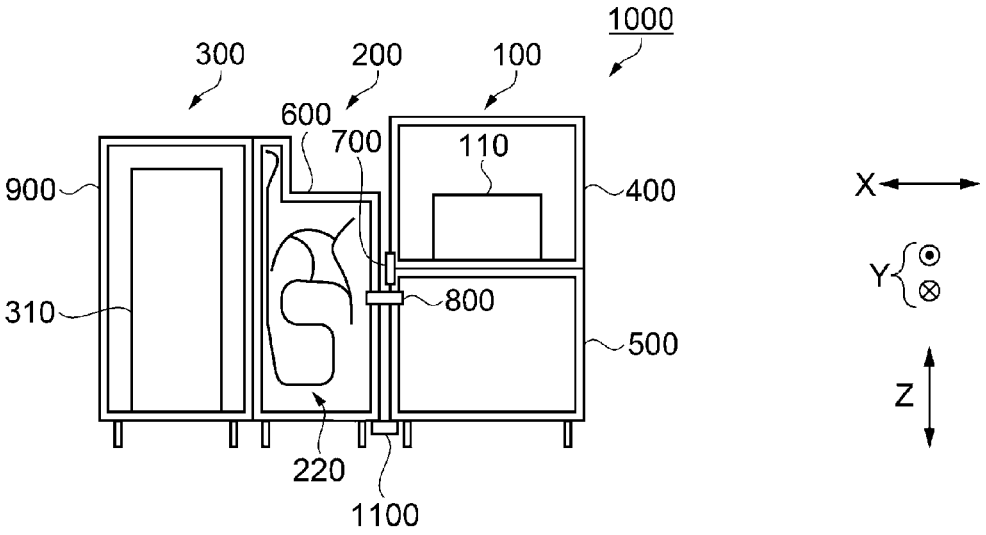
FIG. 18 is a view schematically illustrating disposition of a housing of the recording system.

FIG. 18 is a view schematically illustrating disposition of each housing in the recording system 1000 of the embodiment. In the recording system 1000, the printer 100, the first post processing apparatus 200, and the second post processing apparatus 300 are aligned in order from toward the right side to the left side in the drawing in the leftward-and-rightward direction X.

The printer 100 includes the housing 400 in which the recording portion 110 is held on the inside thereof, and the housing 500, and the housing 500 is positioned at a lower part which is an outer side of the housing 400. The first post processing apparatus 200 includes the housing 600 in which the intermediate transport portion 220 that is the first post processing portion is held on the inside thereof. The second post processing apparatus 300 includes a housing 900 in which a second post processing portion 310 that performs the second post processing is held on the inside thereof. The housing 400 and the housing 500 are linked to each other by the first linking portion 700, and the housing 600 and the housing 500 are linked to each other by the second linking portion 800.

Above, the recording system 1000 of FIG. 1 described in the embodiment includes: the housing 400 of FIG. 11 which is a first housing that holds the recording portion 110 of FIG. 2 which performs the recording onto the paper sheet P which is a recording medium on the inside thereof, and supports the discharge roller pair 136 which discharges the paper sheet P recorded by the recording portion 110; the housing 500 which is a second housing disposed at a lower part that is an outer side of the housing 400; and the housing 600 of FIG. 10 which is a third housing that holds the intermediate transport portion 220 which is a first post processing portion that performs the predetermined first post processing on the inside thereof, and supports the transport roller pair 204 of FIG. 6 which receives the paper sheet P discharged by the discharge roller pair 136 and transports the paper sheet P to the intermediate transport portion 220 side.

In addition, the first linking portion 700 which regulates the position of the housing 500 with respect to the housing 400 of FIG. 13. The second lining portion 800 regulates the positions of the first linking portion 700 (which links the housing 400 and the housing 500 to each other) and the housing 600 with respect to the housing 500 of FIG. 14, applies the load received from the housing 600 to the housing 500, and links the housing 500 and the housing 600 to each other.

According to the configuration, since the load received from the housing 600 (third housing) is not applied to the housing 400 (first housing), distortion is not generated in the housing 400. Therefore, the discharge roller pair 136 supported by the housing 400 is provided at a position in the height direction which can deliver the paper sheet P, and the rotation axes of each of the discharge roller pair 136 and the transport roller pair 204 are disposed to be parallel to each other. Therefore, when the paper sheet P discharged from the discharge roller pair 136 is nipped by the transport roller pair 204 and delivered, the inclination of the paper sheet P with respect to the transport direction is suppressed.

In addition, the load received from the housing 600 (third housing) is not applied to the housing 400 (first housing), the distortion is not generated in the housing 400, and accordingly, the relative position between the transported paper sheet P and the recording portion 110 is appropriately held, and the positional accuracy of the ink ejected onto the paper sheet P is ensured. Therefore, deterioration of quality of the image recorded on the paper sheet P can be suppressed.

In addition, the housing 900 (fourth housing) which receives the paper sheet P discharged from the intermediate transport portion 220 (first post processing portion) and holds the second post processing portion 310 of FIG. 18 which performs the predetermined second post processing with respect to the paper sheet P on the inside thereof, is provided. As described above, the contents of the second post processing are, for example, cutting, folding, punching, stapling, and sorting.

According to the configuration, in a state where the inclination angle with respect to the transport direction is small, the paper sheet P which passes through the intermediate transport portion 220 is transported to the second post processing portion 310. Accordingly, appropriate processing is performed in the second post processing portion 310.

In addition, the second linking portion 800 of FIG. 14 is configured of the protrusion portion 803 which is provided in the housing 500 (second housing) and protrudes to the other side, and the hole portions 820 and 821 which are provided in the housing 600 (third housing) and is open to the housing 500 side, and as the protrusion portion 803 is fitted to the hole portions 820 and 821, the position of the housing 600 with respect to the housing 500 is regulated.

According to the configuration, in a state where the protrusion portion 803 is fitted to the hole portions 820 and 821, the positions of the housing 500 and the housing 600 in the forward-and-rearward direction Y which intersects with the leftward-and-rightward direction X and in the vertical direction Z, are regulated. In addition, in the leftward-and-rightward direction X in which the housing 500 and the housing 600 are aligned, the distance between the housing 500 and the housing 600 is changeable, and thus, it is possible to easily attach or detach the housing 600 to and from the housing 500. Furthermore, the hole portion may be provided in the housing 500, and the protrusion portion may be provided in the housing 600.

In addition, on the side opposite to the housing 500 (second housing) in the bottom portion 201*e* of the housing 600 (third housing), the caster 250 which is in contact with the installation surface and serves as a load receiving portion which receives a part of the load received from the housing 600 is provided, and the housing 500 side in the bottom portion of the housing 600 does not abut against the installation surface.

According to the configuration, the weight of the housing 600 including the intermediate transport portion 220 is applied to the caster 250 and the protrusion portion 803 inserted into the hole portions 820 and 821 as a load from the housing 600. In addition, the position of the housing 600 with respect to the housing 500 is regulated by the positions of the hole portions 820 and 821 to which the protrusion portion 803 is fitted. In other words, the position of the housing 600 with respect to the housing 500 is regulated by the position linked by the second linking portion 800, and the load received from the housing 600 is applied to the caster 250 and the second linking portion 800.

In addition, the second linking portion 800 of FIG. 14 is configured of the hook 810 which is provided in the housing 600 (third housing) and is a rotatable engagement portion, and the columnar member 801 which is provided in the housing 500 (second housing) and is an engaged portion which can be engaged with the hook 810, and the hook 810 is in a state of being engaged with the columnar member 801 when being rotated in one direction in the rotational direction D2 or in a state of not being engaged with the columnar member 801 when being rotated in the other direction in the rotational direction D2.

According to the configuration, work of placing the second linking portion 800 to be in a linked state, or workability when releasing the linked state of the second linking portion 800 is excellent.

In addition, the abutting portion 1100 of FIG. 17 is configured of the first abutting member 510 which is provided at a position that opposes the housing 600 (third housing) of the first post processing apparatus 200 below the first linking portion 700 and the second linking portion 800 of the housing 500 (second housing) of the printer 100; and the second abutting member 610 which is provided at a position that opposes the first abutting member 510 of the housing 600 (third housing) of the first post processing apparatus 200.

According to the configuration, in a state where the housing 500 of the printer 100 and the housing 600 of the first post processing apparatus 200 are linked to each other by the second linking portion 800, by allowing the first abutting member 510 provided in the housing 500 and the second abutting member 610 provided in the housing 600 to abut against each other, the position in the leftward-and-rightward direction X which is the direction in which the housing 500 and the housing 600 are aligned is regulated.

In addition, in the first abutting member 510 of FIG. 15, the conduction member 514 which is configured of a conductive member and has elasticity in the vertical direction Z in the overhang portion 513 that is overhung in the leftward-and-rightward direction X on the housing 600 (third housing) side is disposed. When the housing 500 (second housing) and the housing 600 (third housing) are linked to each other, the first abutting member 510 and the second abutting member 610 abut against each other, and the conduction member 514 is disposed below the cover 621 which covers a part of the second abutting member 610.

According to the configuration, as the overhang portion 513 in which the conduction member 514 having elasticity is disposed in the vertical direction Z is inserted into a lower part of the housing 600, the elasticity to the cover 621 side fixed to the housing 600 of the conduction member 514 can be used, and the conduction member 514 can be stably brought into contact with the cover 621. Therefore, the housing 500 and the housing 600 can be electrically conducted and malfunction of the recording system 1000 can be reduced by electric noise or the like.

Figure 19:
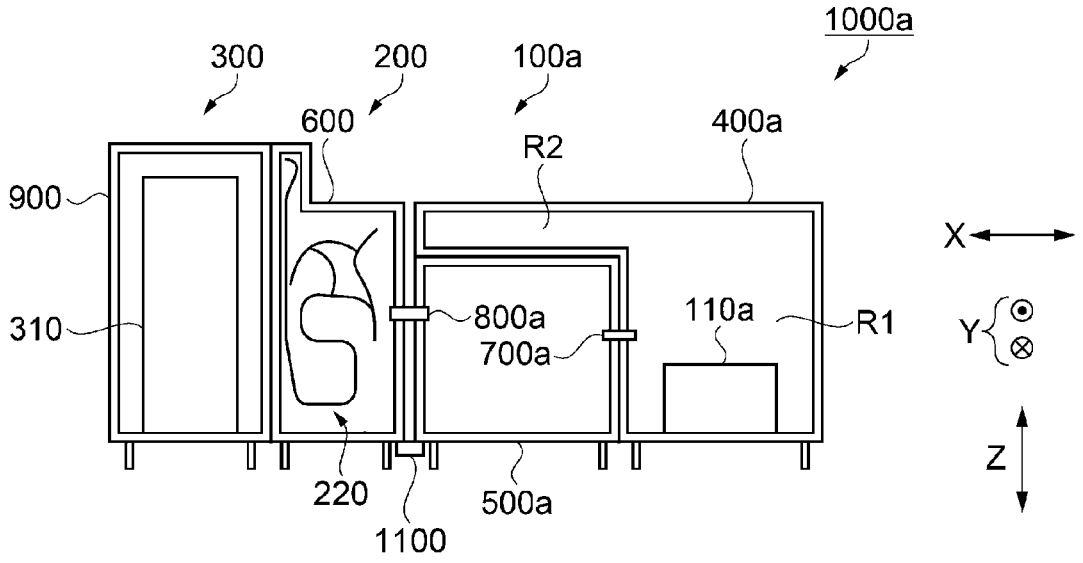
FIG. 19 is a view schematically illustrating disposition of a housing of a recording system in another embodiment.

In the embodiment, the housing 500 which is a second housing is disposed at a position on the outer side at a lower part in the vertical direction Z of the housing 400 which is a first housing, but the second housing may be disposed on the outer side in the leftward-and-rightward direction X of the first housing. FIG. 19 is a view schematically illustrating disposition of each housing of a recording system 1000*a* in another embodiment.

In the recording system 1000*a*, a printer 100*a*, the first post processing apparatus 200, and the second post processing apparatus 300 are aligned in order toward a left side from a right side in the drawing in the leftward-and-rightward direction X. A housing 400*a* which is a first housing and a housing 500*a* which is a second housing are linked to each other by a first linking portion 700*a*, and the housing 600 and the housing 500*a* are linked to each other by a second linking portion 800*a*.

The printer 100*a* includes the housing 400*a* in which a recording portion 110*a* is held on the inside thereof, and the housing 500*a*. In the housing 400*a*, a region R1 in which the recording portion 110*a* is accommodated and a region R2 to which the paper sheet P recorded by the recording portion 110*a* is transported are formed. The housing 500*a* is positioned further on a left side of the drawing in the leftward-and-rightward direction X than the region R1 of the housing 400*a*, and is positioned further at a lower part in the vertical direction Z than the region R2 of the housing 400*a*. In other words, the housing 500*a* which is a second housing is disposed on the outer side of the housing 400*a* which is a first housing.

Figure 20:
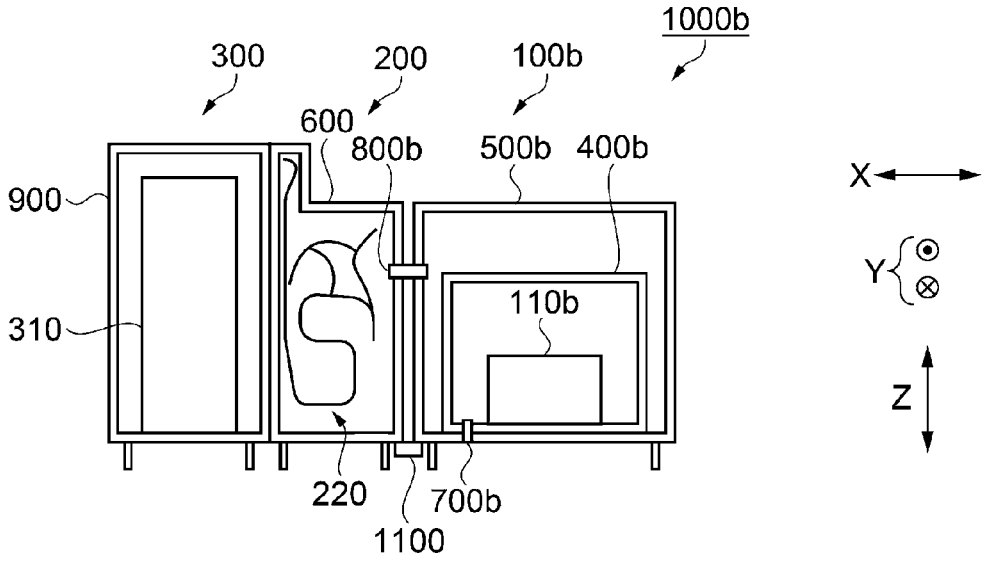
FIG. 20 is a view schematically illustrating disposition of a housing of a recording system in another embodiment.

In addition, as an example in which the second housing is disposed on the outer side of the first housing, the first housing may be disposed on the inside of the second housing. FIG. 20 is a view schematically illustrating disposition of each housing of a recording system 1000*b* in another embodiment.

In the recording system 1000*b*, a printer 100*b*, the first post processing apparatus 200, and the second post processing apparatus 300 are aligned in order toward a left side from a right side in the drawing in the leftward-and-rightward direction X. A housing 400*b* which is a first housing and a housing 500*b* which is a second housing are linked to each other by a first linking portion 700*b*, and the housing 600 and the housing 500*b* are linked to each other by a second linking portion 800*b*.

The printer 100*b* includes the housing 400*b* in which a recording portion 110*b* is held inside thereof, and the housing 500*b*. The housing 400*b* is disposed on the inside of the housing 500*b*.

In the above-described embodiment, the recording apparatus may be a liquid ejecting apparatus which performs the recording by ejecting or dispensing fluid (liquid, a liquid body in which particles of a functional material are dispersed or mixed into the liquid, or a flowing body, such as gel) other than the ink. For example, the recording apparatus may be a liquid body ejecting apparatus which performs the recording by ejecting the liquid body that includes a material, such as an electrode material or coloring material (pixel material), which is used in manufacturing or the like liquid crystal display, electro-luminescence (EL) display, and surface light emission display, by being dispersed or dissolved. In addition, the recording apparatus may be a flowing body ejection apparatus which ejects the flowing body, such as gel (for example, physical gel). In addition, the disclosure can be employed in any one type of the fluid ejection apparatuses. In addition, the "fluid" in the specification is a concept which does not include fluid made of only gas, and examples of the fluid include liquid (including inorganic solvent, organic solvent, solution, liquid resin, liquid metal (melt metal), and the like), the liquid body, and the flowing body.

What is claimed is:

1. A recording system comprising:

a first housing which holds a recording portion that performs recording on a recording medium on the inside thereof, and supports a discharge roller pair that discharges the recording medium onto which the recording is performed by the recording portion;

a second housing which is disposed on an outer side of the first housing, the first housing being on top of the second housing;

a third housing which holds a first post processing portion that performs first post processing on the inside thereof, and supports a transport roller pair that receives the recording medium discharged by the discharge roller pair and transports the recording medium to the first post processing portion side, the third housing being part of a post processing apparatus that is next to the first and second housing, and that rests on an installation surface;

a first linking portion which regulates a position of the second housing with respect to the first housing, and links the first housing and the second housing to each other; and a second linking portion which regulates a position of the third housing with respect to the second housing, applies a load received from the third housing to the second housing, and links the second housing and the third housing to each other.

2. The recording system according to claim 1, further comprising:

a fourth housing which receives the recording medium discharged from the first post processing portion, and holds a second post processing portion that performs predetermined second post processing with respect to the recording medium on the inside thereof.

3. The recording system according to claim 1, wherein the second linking portion includes a protrusion portion which is provided on one side and protrudes to the other side, and a hole portion which is provided on the other side and is open to one side, in the second housing and the third housing, and wherein a position of the third housing with respect to the second housing is regulated by fitting the protrusion portion to the hole portion.

4. The recording system according to claim 1, wherein a load receiving portion which is in contact with an installation surface, and receives a part of the load received from the third housing is provided on a side opposite to the second housing side in a bottom portion of the third housing, and the second housing side in the bottom portion of the third housing does not abut against the installation surface.

5. The recording system according to claim 1, wherein the second linking portion includes a rotatable engagement portion provided in the third housing, and an engaged portion that is provided in the second housing and is engageable with the engagement portion, and wherein the engagement portion is in a state of being engaged with the engaged portion when being rotated in one direction in a rotational direction, and in a state of not being engaged with the engaged portion when being rotated in the other direction in the rotational direction.

6. The recording system according to claim 1, wherein the second housing includes a first abutting member at a position that opposes the third housing further at a lower part than the first linking portion and the second linking portion, wherein the third housing includes a second abutting member at a position that opposes the first abutting member, and wherein a position in a direction in which the second housing and the third housing are aligned is regulated as the first abutting member and the second abutting member abut against each other.

7. The recording system according to claim 6, wherein the first abutting member is a conductive member, and wherein the first abutting member includes an overhang portion which is overhung on the third housing side, and a conduction member which is conducted to the inside of the third housing is disposed in the overhang portion.

8. The recording system according to claim 7, wherein the conduction member has elasticity and is conducted to the inside of the third housing.

* * * * *